US010731431B2

(12) United States Patent
Massey et al.

(10) Patent No.: US 10,731,431 B2
(45) Date of Patent: Aug. 4, 2020

(54) DOWNHOLE IMPACT APPARATUS

(71) Applicant: IMPACT SELECTOR INTERNATIONAL, LLC, Houma, LA (US)

(72) Inventors: James P. Massey, Breckenridge, CO (US); Thomas Wilson, Garland, TX (US); Edward Saville, Sugar Land, TX (US)

(73) Assignee: Impact Selector International, LLC, Houma, LA (US)

( * ) Notice: Subject to any disclaimer, the term of this patent is extended or adjusted under 35 U.S.C. 154(b) by 257 days.

(21) Appl. No.: 15/979,262

(22) Filed: May 14, 2018

(65) Prior Publication Data

US 2018/0258724 A1 Sep. 13, 2018

Related U.S. Application Data

(63) Continuation of application No. PCT/US2016/062249, filed on Nov. 16, 2016.
(Continued)

(51) Int. Cl.
*E21B 31/107* (2006.01)
*E21B 31/113* (2006.01)
*E21B 17/06* (2006.01)

(52) U.S. Cl.
CPC ..... *E21B 31/1075* (2013.01); *E21B 17/06* (2013.01); *E21B 31/113* (2013.01); *E21B 31/1135* (2013.01)

(58) Field of Classification Search
CPC .. E21B 31/1075; E21B 31/107; E21B 31/113; E21B 31/1135
See application file for complete search history.

(56) References Cited

U.S. PATENT DOCUMENTS 2,733,045 A 1/1956 Burns, Jr. et al.
2,837,315 A 6/1958 Burns, Jr. et al.
(Continued)

FOREIGN PATENT DOCUMENTS

AU 2015249878 A1 6/2016
WO 2009047708 A2 4/2009
WO 2017087504 A1 5/2017

OTHER PUBLICATIONS

PCT/IB2017/056911, filed Feb. 23, 2018, International Search Report dated Nov. 5, 2017, 5 pages.
(Continued)

*Primary Examiner* — Robert E Fuller
(74) *Attorney, Agent, or Firm* — Boisbrun Hofman, PLLC

(57) ABSTRACT

Apparatus and methods for creating a downhole impact. The apparatus may be an impact tool operable to be coupled between portions of a tool string conveyable within a wellbore extending into a subterranean formation. The impact tool may include a housing, a chamber within the housing, a piston slidably disposed within the chamber and dividing the chamber into a first chamber volume and a second chamber volume, and a shaft connected with the piston and axially movable with respect to the housing. The first chamber volume may be open to a space external to the housing and the second chamber volume may be fluidly isolated from the space external to the housing. The piston may be maintained in a predetermined position within the chamber to maintain pressure within the second chamber volume appreciably lower than pressure within the first chamber volume while the impact tool is conveyed along the wellbore.

20 Claims, 9 Drawing Sheets

Related U.S. Application Data

(60) Provisional application No. 62/336,443, filed on May 13, 2016, provisional application No. 62/257,384, filed on Nov. 19, 2015.

(56) References Cited

U.S. PATENT DOCUMENTS

| | | | |
|---|---|---|---|
| 6,182,775 | B1 | 2/2001 | Hipp |
| 2009/0095490 | A1 | 4/2009 | Moriarty et al. |
| 2012/0227970 | A1 | 9/2012 | Schultz et al. |

OTHER PUBLICATIONS

PCT/US2016/062249 filed Nov. 16, 2016, Written Opinion of the International Searching Authority, dated Apr. 3, 2017, 10 pages.

DOWNHOLE IMPACT APPARATUS

CROSS-REFERENCE TO RELATED APPLICATIONS

This application is a continuation of, and claims priority to and the benefit of, International Patent Application No. PCT/US2016/062249, tilted "DOWNHOLE APPARATUS," filed Nov. 16, 2016, which claims priority to and the benefit of U.S. Provisional Application No. 62/336,443, titled "DOWNHOLE APPARATUS," filed May 13, 2016, and U.S. Provisional Application No. 62/257,384, titled "DOWNHOLE IMPACT APPARATUS," filed Nov. 19, 2015, the entire disclosures of which are hereby incorporated herein by reference.

BACKGROUND OF THE DISCLOSURE

Drilling operations have become increasingly expensive as the need to drill deeper, in harsher environments, and through more difficult materials has become a reality. In addition, testing and evaluation of completed and partially finished wellbores has become commonplace, such as to increase well production and return on investment. Consequently, in working with deeper and more complex wellbores, it becomes more likely that tools, tool strings, and/or other downhole equipment may become stuck within the wellbore.

A downhole impact or jarring tool may be utilized to dislodge stuck downhole equipment. The impact or jarring tool (hereafter collectively referred to as simply "impact tool") may be included as part of a tool string and deployed downhole along with the downhole equipment, or the impact tool may be deployed downhole after equipment already downhole becomes stuck. Tension may be applied from a wellsite surface to the deployed tool string via a conveyance means to store elastic energy in the tool string and the conveyance means. After sufficient tension is applied to the impact tool, the impact tool may be triggered to release the elastic energy in the impact tool and the conveyance means, thereby delivering an impact intended to dislodge the stuck downhole tool or to break a shear pin to disconnect a portion of the tool string from the stuck downhole tool.

However, in some downhole applications, such as in deviated wellbores or when multiple bends are present along the wellbore, friction between a sidewall of the wellbore and the conveyance means may reduce or prevent adequate tension from being applied to the impact tool. In such situations, the impact tool may be unable to produce an impact that is sufficient to dislodge the stuck downhole tool or break the shear pin.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
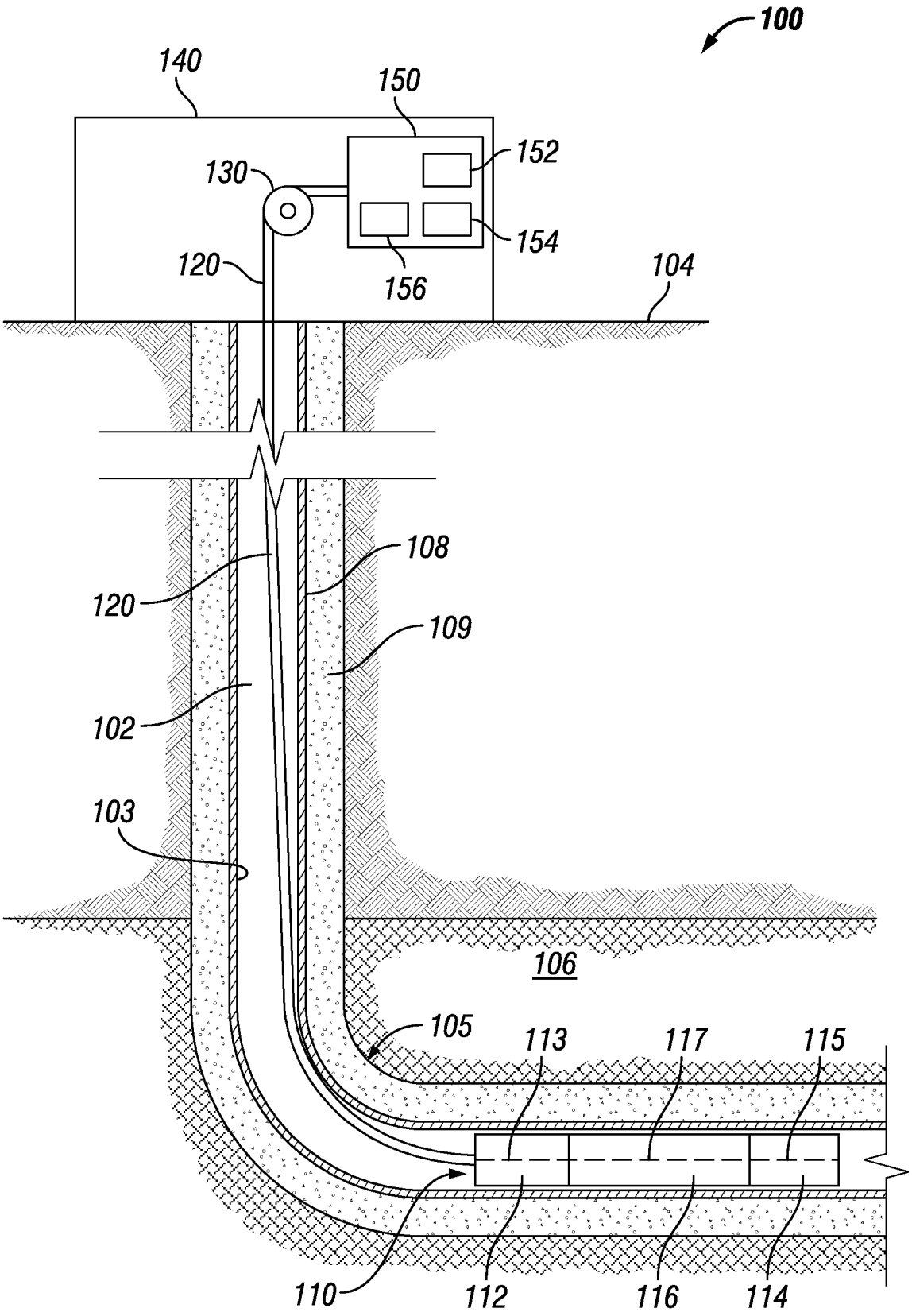
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

As introduced herein, a downhole tool within the scope of the present disclosure may be operable to store energy in the form of pressure differential between ambient wellbore pressure external to the downhole tool and an internal pressure of the downhole tool and to release or utilize such pressure differential to perform work in the form of a downhole operation. The downhole tool may comprise a housing, a chamber within the housing, and a movable sealing member fluidly isolating the chamber from the space external to the downhole tool. During downhole conveyance of the downhole tool, the sealing member may be maintained in position and the pressure within the chamber may be maintained constant or otherwise appreciably lower than the wellbore pressure within the space external to the downhole tool. As the downhole tool is conveyed deeper within the wellbore and the pressure within the wellbore increases, an increasing pressure differential may be formed across the sealing member, storing an increasing amount of energy. Releasing or freeing the sealing member from or with respect to the housing may permit the pressure differential to cause relative movement between the sealing member and housing. Such relative movement may be utilized to perform work in the form of a downhole operation.

FIG. 1 is a schematic view of at least a portion of a wellsite system 100 showing an example environment comprising or utilized in conjunction with a pressure differential downhole tool according to one or more aspects of the present disclosure. The wellsite system 100 may comprise a tool string 110 suspended within a wellbore 102 that extends from a wellsite surface 104 into one or more subterranean formations 106. The wellbore 102 may be a cased-hole implementation comprising a casing 108 secured by cement 109. However, one or more aspects of the present disclosure are also applicable to and/or readily adaptable for utilizing in open-hole implementations lacking the casing 108 and cement 109. The tool string 110 may be suspended within the wellbore 102 via a conveyance means 120 operably coupled with a tensioning device 130 and/or other surface equipment 140 disposed at the wellsite surface 104, including a power and control system 150.

The tensioning device 130 may apply an adjustable tensile force to the tool string 110 via the conveyance means 120 to convey the tool string 110 along the wellbore 102. The tensioning device 130 may be, comprise, or form at least a portion of a crane, a winch, a draw-works, a top drive, and/or another lifting device coupled to the tool string 110 by the conveyance means 120. The conveyance means 120 may be or comprise a wireline, a slickline, an e-line, coiled tubing, drill pipe, production tubing, and/or other conveyance means, and may comprise and/or be operable in conjunction with means for communication between the tool string 110, the tensioning device 130, and/or one or more other portions of the surface equipment 140, including the power and control system 150. The conveyance means 120 may also comprise a multi-conductor wireline and/or other electrical conductor(s) extending between the tool string 110 and the surface equipment 140. The power and control system 150 may include a source of electrical power 152, a memory device 154, and a controller 156 for receiving and process electrical signals from the tool string 110 and/or commands from a surface operator.

The tool string 110 is shown suspended in a non-vertical portion of the wellbore 102 resulting in the conveyance means 120 coming into contact with a sidewall 103 of the wellbore 102 along a bend or deviation 105 in the wellbore 102. The contact may cause friction between the conveyance means 120 and the sidewall 103, such as may impede or reduce the tension being applied to the tool string 110 by the tensioning device 130.

The tool string 110 may comprise an uphole portion 112, a downhole portion 114, and a pressure differential downhole tool 116 coupled between the uphole portion 112 and the downhole portion 114. The uphole and downhole portions 112, 114 of the tool string 110 may each be or comprise one or more downhole tools, modules, and/or other apparatus operable in wireline, while-drilling, coiled tubing, completion, production, and/or other implementations. The uphole portion 112 of the tool string 110 may comprise at least one electrical conductor 113 in electrical communication with at least one component of the surface equipment 140. The downhole portion 114 of the tool string 110 may also comprise at least one electrical conductor 115 in electrical communication with at least one component of the surface equipment 140, wherein the at least one electrical conductor 113 and the at least one electrical conductor 115 may be in electrical communication via at least one electrical conductor 117 of the downhole tool 116. Thus, the electrical conductors 113, 115, 117 may connect with and/or form a portion of the conveyance means 120, and may include various electrical connectors and/or interfaces along such path, including as described below.

Each of the electrical conductors 113, 115, 117 may comprise a plurality of individual conductors, such as may facilitate electrical communication of the uphole portion 112 of the tool string 110, the downhole tool 116, and the downhole portion 114 of the tool string 110 with at least one component of the surface equipment 140, such as the power and control system 150. For example, the conveyance means 120 and the electrical conductors 113, 115, 117 may transmit and/or receive electrical power, data, and/or control signals between the power and control system 150 and one or more of the uphole portion 112, the downhole tool 116, and the downhole portion 114. The electrical conductors 113, 115, 117 may further facilitate electrical communication between two or more of the uphole portion 112, the downhole tool 116, and the downhole portion 114. Each of the uphole portion 112, the downhole portion 114, the downhole tool 116, and/or portions thereof may comprise one or more electrical connectors, such as may electrically connect the electrical conductors 113, 115, 117 extending therebetween.

The uphole and downhole portions 112, 114 of the tool string 110 may each be or comprise at least a portion of one or more downhole tools, modules, and/or other apparatus operable in wireline, while-drilling, coiled tubing, completion, production, and/or other operations. For example, the uphole and downhole portions 112, 114 may each be or comprise at least a portion of a perforating tool, a cutting tool, an acoustic tool, a density tool, a directional tool, an electromagnetic (EM) tool, a formation evaluation tool, a gravity tool, a formation logging tool, a magnetic resonance tool, a formation measurement tool, a monitoring tool, a neutron tool, a nuclear tool, a photoelectric factor tool, a porosity tool, a reservoir characterization tool, a resistivity tool, a seismic tool, a surveying tool, a release tool, a mechanical interface tool, a perforating tool, a cutting tool, a plug setting tool, and a plug.

The uphole and downhole portions 112, 114 may each further comprise inclination sensors and/or other position sensors, such as one or more accelerometers, magnetometers, gyroscopic sensors (e.g., micro-electro-mechanical system (MEMS) gyros), and/or other sensors for utilization in determining the orientation of the tool string 110 relative to the wellbore 102.

The uphole and downhole portions 112, 114 may also comprise a correlation tool, such as a casing collar locator (CCL) for detecting ends of casing collars by sensing a magnetic irregularity caused by the relatively high mass of an end of a collar of the casing 108. The uphole and downhole portions 112, 114 may also or instead be or comprise a gamma ray (GR) tool that may be utilized for depth correlation. The CCL and/or GR tools may transmit signals in real-time to the wellsite surface equipment 140, such as the power and control system 150, via the conveyance means 120. The CCL and/or GR signals may be utilized to determine the position of the tool string 110 or portions thereof, such as with respect to known casing collar numbers and/or positions within the wellbore 102. Therefore, the CCL and/or GR tools may be utilized to detect and/or log the location of the tool string 110 within the wellbore 102, such as during intervention operations.

Although FIG. 1 depicts the tool string 110 comprising a single downhole tool 116 directly coupled between two tool string portions 112, 114, it is to be understood that the tool string 110 may include two, three, four, or more downhole tools 116 coupled together, or the downhole tools 116 may be separated from each other along the tool string 110 by the tool string portions 112, 114. Furthermore, the tool string 110 may comprise a different number of tool string portions 112, 114, wherein each tool string portion 112, 114 may be directly and/or indirectly coupled with the downhole tool 116. It is also to be understood that the downhole tool 116 may be coupled elsewhere along the tool string 110, whether in an uphole or downhole direction with respect to the uphole and downhole portions 112, 114 of the tool string 110.

An example implementation of the downhole tool 116 within the scope of the present disclosure may be or comprise an impact or jarring tool operable to impart an impact or force to a stuck portion of a tool string, such as one of the tool string portions 112, 114. To perform impact or jarring operations, impact tools store energy in conveyance means operable to convey a tool string into a wellbore. When a portion of the tool string gets stuck or jammed within the wellbore, the conveyance means is pulled in an uphole direction to build up tension and, thus, store energy in the stretched conveyance means to be released by the impact tool at a predetermined time or situation. However, the impact tool within the scope of the present disclosure may utilize pressure differential between internal and external portions of the impact tool to actuate or energize the impact tool to impart an impact or force to a stuck portion of a tool string. The impact tool may utilize an internal chamber and a slidable or otherwise movable sealing member, such as a piston and shaft assembly, to fluidly isolate the chamber from a space external to the impact tool to store energy that may be selectively released to actuate or energize the impact tool to impart the impact to the tool string.

The chamber may contain therein air or another gas at a predetermined pressure, such as atmospheric pressure (i.e., surface pressure) or another predetermined pressure. One side of the piston may be exposed to the chamber and, thus, the chamber pressure, while an opposing side of the piston may be exposed to environment or space external to the impact tool and, thus, external pressure. As the impact tool is conveyed downhole, the pressure within the chamber may be maintained substantially constant or otherwise appreciably less than wellbore pressure outside of the impact tool. As the hydrostatic pressure around the impact tool and against the externally exposed portion of the piston increases, a pressure differential across the piston may be formed. The piston may be locked in a predetermined position with respect to a housing or body of the impact tool to prevent movement of the piston with respect to the housing or chamber. Because the downhole pressure may be high, the potential energy stored by or within the isolated chamber and piston system may also be high. The potential energy may be utilized to accelerate the piston with respect to the housing or chamber and, thus, convert potential energy to kinetic energy to create the impact force.

A surface operator may transmit a signal from a wellsite surface to the impact tool to release the piston to permit the pressure differential to cause relative movement between the piston and housing. The relative movement may accelerate a portion of the tool string which is not stuck. The relative movement between the piston and housing may terminate when the piston, housing, and/or other portions of the impact tool contact or impact each other to suddenly stop or decelerate the moving portion of the tool string, causing an impact force to be imparted through the impact tool to the stuck portion of the tool string.

Figure 2:
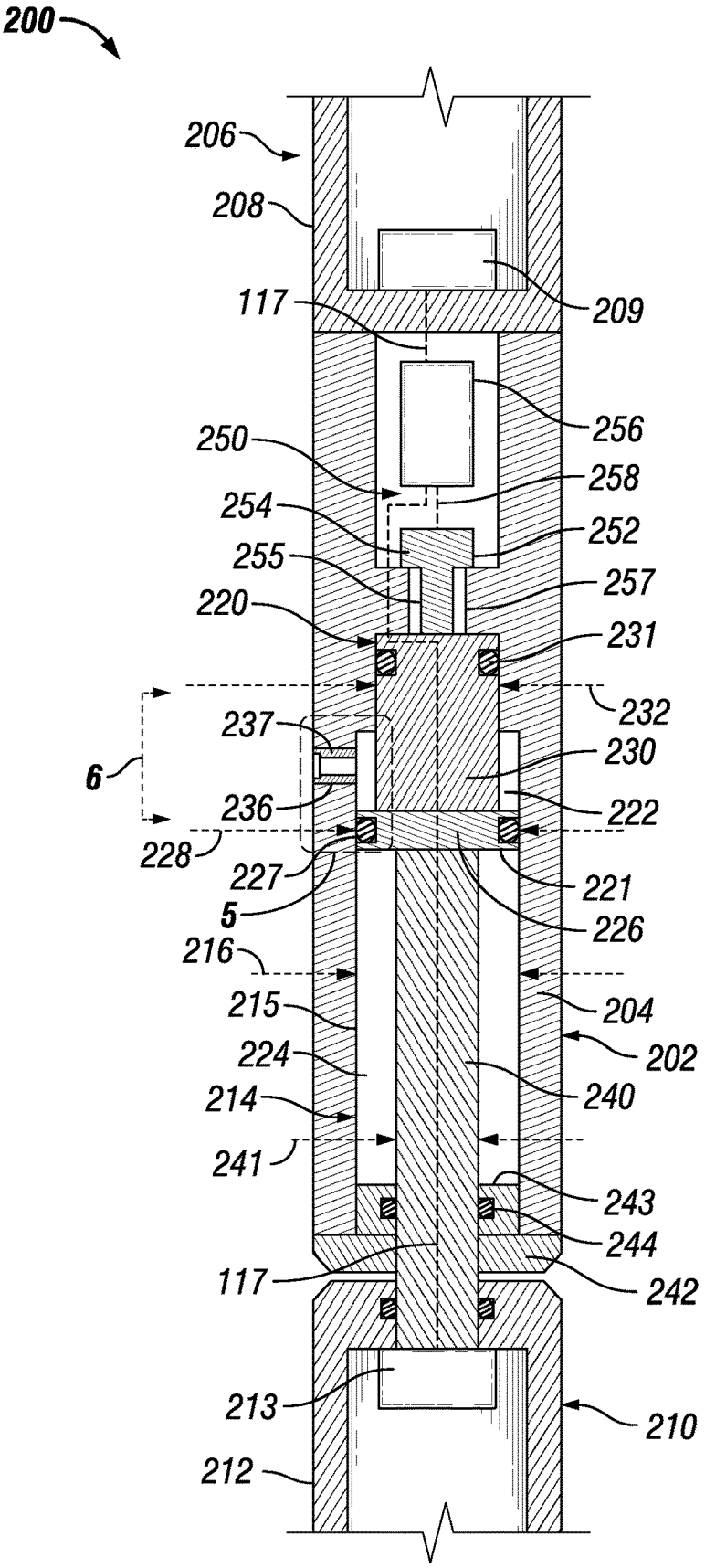
FIG. 2 is a schematic view of a portion of an example implementation of apparatus according to one or more aspects of the present disclosure.
Figure 3:
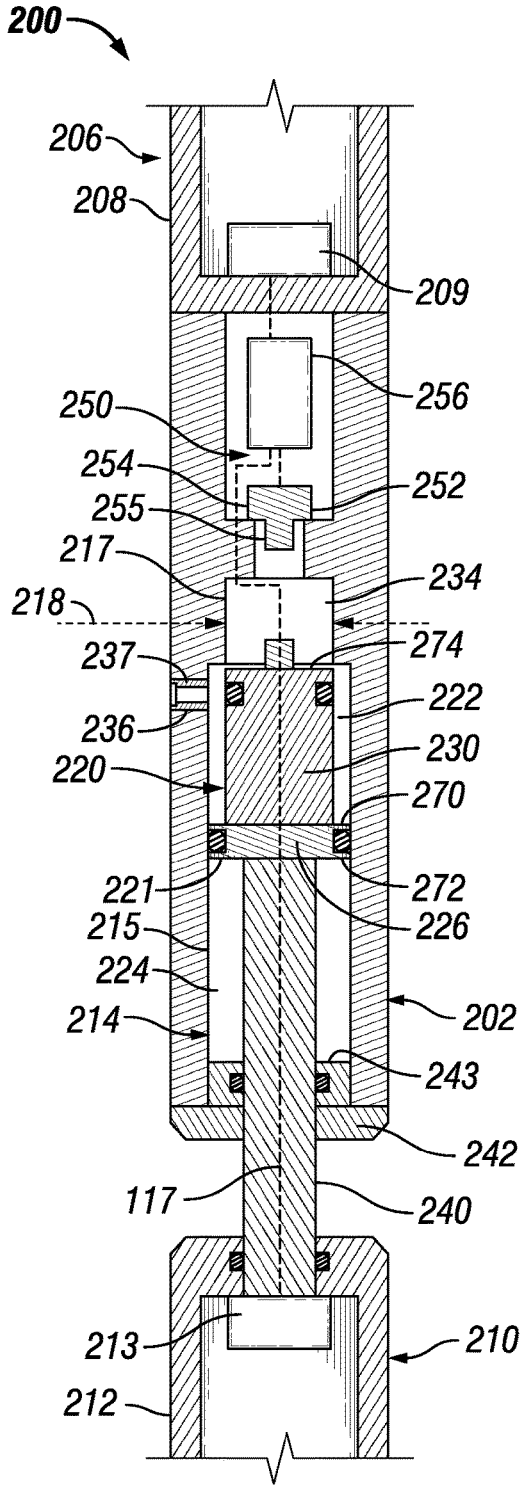
FIG. 3 is a schematic view of the apparatus shown in FIG. 2 at different stage of operation.
Figure 4:
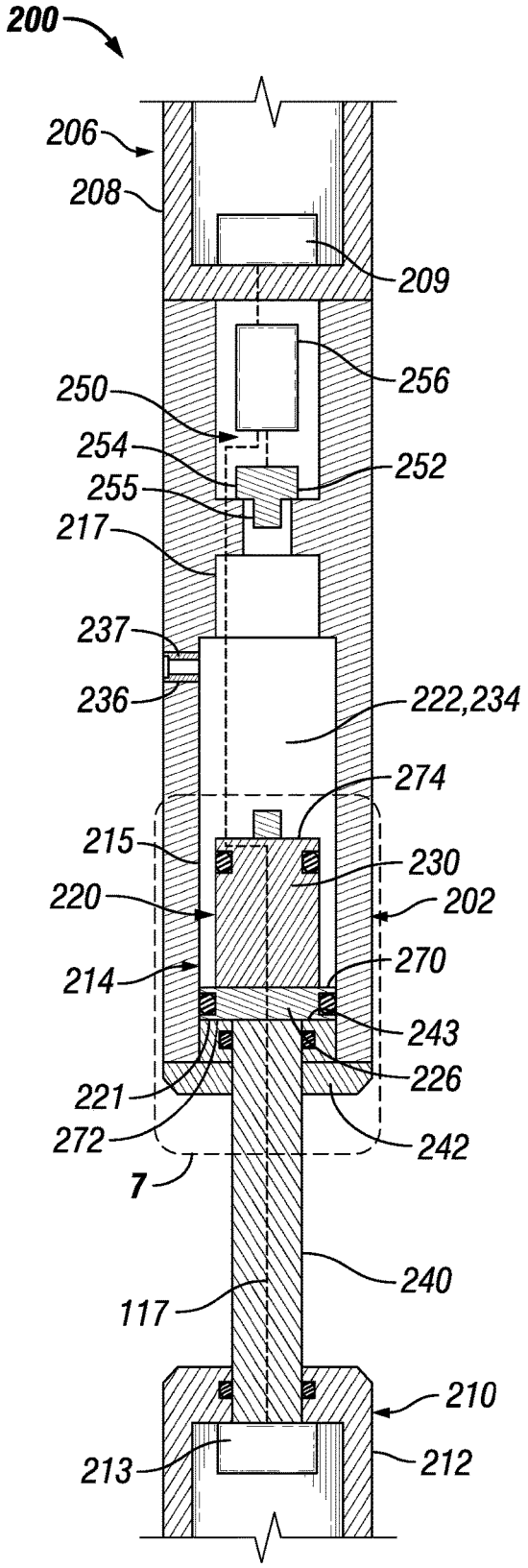
FIG. 4 is a schematic view of the apparatus shown in FIGS. 2 and 3 at different stage of operation.

FIGS. 2-4 are schematic views of at least a portion of the pressure differential downhole tool 116 shown in FIG. 1 implemented as an impact tool according to one or more aspects of the present disclosure and designated in FIGS. 2-4 by reference numeral 200. FIGS. 2-4 show the impact tool 200 at different stages of impact operation. The following description refers to FIGS. 1-4, collectively.

The impact tool 200 comprises a housing 202 having a wall 204 defining or containing a plurality of internal spaces or volumes encompassing various components of the impact tool 200. Although the housing 202 is shown as comprising a single unitary member, it is to be understood that the housing 202 may be or comprise a plurality of housing portions coupled together to form the housing 202.

An uphole end 206 of the impact tool 200 may include a mechanical interface, a sub, and/or other means 208 for mechanically coupling the impact tool 200 with a corresponding mechanical interface (not shown) of the uphole portion 112 of the tool string 110. The interface means 208 may be integrally formed with or coupled to the housing 202, such as via a threaded connection. A downhole end 210 of the impact tool 200 may include a mechanical interface, a sub, and/or other means 212 for mechanically coupling with a corresponding mechanical interface (not shown) of the downhole portion 114 of the tool string 110. The interface means 212 may be integrally formed with or coupled to the housing 202, such as via a threaded connection. The interface means 208, 212 may comprise threaded connectors, fasteners, box-pin couplings, and/or other mechanical coupling means.

The uphole interface means 208 and/or other portion of the uphole end 206 of the impact tool 200 may further include an electrical interface 209 comprising means for electrically coupling an electrical conductor 117 with a corresponding electrical interface (not shown) of the uphole portion 112 of the tool string 110, whereby the corresponding electrical interface of the uphole portion 112 may be in electrical connection with the electrical conductor 113. The downhole interface means 212 and/or other portion of the downhole end 210 of the impact tool 200 may include an electrical interface 213 comprising means for electrically coupling with a corresponding interface (not shown) of the downhole portion 114 of the tool string 110, whereby the corresponding electrical interface of the downhole tool string portion 114 may be in electrical connection with the electrical conductor 115. The electrical interfaces 209, 213 may each comprise electrical connectors, plugs, pins, receptacles, terminals, conduit boxes, and/or other electrical coupling means.

The impact tool 200 may comprise a chamber 214 within the housing 202. The chamber 214 may include chamber portions having different inner diameters. A chamber portion 215 may have an inner diameter 216 that is appreciably larger than an inner diameter 218 of a chamber portion 217. A piston 220 may be slidably disposed within and movable with respect to the housing 202. The piston 220 may be slidably disposed within the chamber 214 and divide the chamber 214 into two or more chamber volumes. The piston 220 may comprise a piston portion 226 sealingly engaging an inner surface of the chamber portion 215 and a piston portion 230 sealingly engaging against an inner surface of the chamber portion 217. Accordingly, the piston portion 226 may have an outer diameter 228 that is appreciably larger than an outer diameter 232 of the piston portion 230. The outer diameter 228 of the piston portion 226 may be substantially similar (e.g., within two millimeters) to the inner diameter 216 of the chamber portion 215, and the outer diameter 232 of the piston portion 230 may be substantially similar (e.g., within two millimeters) to the inner diameter 218 of the chamber portion 217. The piston portion 226 may fluidly separate the chamber portion 215 into opposing chamber volumes 222 and 224. For example, the piston portion 226 may carry a fluid seal 227 to permit the piston portion 226 to slidably move within the chamber portion 215 while preventing fluids located on either side of the piston portion 226 from leaking between the chamber volumes 222 and 224. The piston portion 230 may be slidably disposed within the chamber portion 217, and may carry a fluid seal 231 to permit the piston portion 230 to slidably move within the chamber portion 217 while preventing fluids located on either side of the piston portion 230 from leaking between the chamber portions 215 and 217 when the piston portion 230 is disposed within the chamber portion 217. Accordingly, the piston portion 230 may define or separate the chamber portion 217 into a chamber volume 234 located uphole from the fluid seal 231 and fluidly isolated from the chamber volume 222 located downhole from the fluid seal 231.

The chamber volume 222 may be open to space external to the housing 202 while the chamber volume 224 may be fluidly isolated from the space external to the housing 202 by the piston portion 226. Accordingly, a face area 270 of the piston portion 226 may be exposed to pressure within the space external to the housing 202 while an opposing face area 272 may be exposed to pressure within the chamber volume 224. The chamber volume 222 may be open to or in fluid communication with the space external to the housing 202 via one or more port 236 extending through the housing wall 204 at or near an uphole end of the chamber portion 215. When the impact tool 200 is conveyed downhole, the port 236 may permit wellbore fluid located within the wellbore 102 to flow into or be in fluid communication with the chamber volume 222 such that the pressure within the chamber volume 222 is substantially equal to a hydrostatic pressure within the wellbore 102 external to the housing 202. The pressure within the chamber volume 224 may be maintained substantially constant or otherwise appreciably lower than the wellbore pressure external to the housing 202. Accordingly, a pressure differential across the piston 220 may be formed, imparting a net downhole force on the piston portion 226.

A triggering or release mechanism 250 may be provided within the housing 202 or another portion of the impact tool 200 to latch, hold, or otherwise maintain the piston 220 in a predetermined position with respect to the housing 202 until the release mechanism 250 is operated to release the piston 220 and permit the pressure differential to move the piston and the housing relative to each other. The piston 220 and the chamber 214 permit a reduced amount of force to be exerted on a release mechanism 250 while holding the piston 220 in the predetermined position. Such reduced force may be achieved by reducing the surface area of the piston 220 exposed to the wellbore pressure while maintaining the piston 220 in position. For example, providing the piston 220 having the piston portion 226 engaging the chamber portion 215 and the piston portion 230 engaging the chamber portion 217 reduces the total face area of the piston 220 exposed to the wellbore pressure as face area 270 of the piston portion 226 is exposed to the wellbore pressure and the face area 274 of the piston portion 230 is isolated from the wellbore pressure. However, after the piston 220 is released, the piston 220 moves downhole with the reduced force until the piston portion 230 and/or the fluid seal 231 exits the chamber portion 217 (as shown in FIG. 3) at which point the full face area (i.e., combined face areas 270, 274) of the piston 220 is exposed to the wellbore pressure, increasing the force exerted on the piston 220. The increased force increases acceleration and speed of the piston 220 for the duration of the piston stroke. The operation of the piston 220 and the release mechanism 250 is described in additional detail below.

The impact tool 200 may be implemented without the force reducing features described above, such as with a piston comprising a uniform or single diameter engaging a chamber comprising a uniform or single diameter. For example, the piston 220 may comprise the piston portion 226, but may not comprise the piston portion 230, while the chamber 214 may comprise the chamber portion 215, but may not comprise the chamber portion 217. Accordingly, such piston 220 may fluidly separate the chamber 214 to define the chamber volume 222 and the chamber volume 224, but may not define or otherwise form the chamber volume 234.

Although the piston 220 may be described herein as the moving component of the impact tool 200, it is done so for clarity and ease of understanding. However, it is to be understood that the pressure differential across the piston 220 may cause the housing 202 to move with respect to the piston 220, for example, when the uphole tool string portion 112 is free and the downhole tool string portion 114 is stuck within the wellbore 102.

The impact tool 200 may be adjustable to control the magnitude of the impact generated by the impact tool 200. Wellbores may have different pressures and the same wellbore may have different pressures at different depths. Since energy available for creating the impact is proportional to the wellbore pressure in the space around the impact tool 200, the impact tool 200 may comprise a means of varying velocity of the relative motion between the housing 202 and piston 220 in order to impart the intended impact force. Accordingly, a flow restrictor 237 may be disposed within the port 236 to reduce or otherwise control the rate of fluid flow from the space external to the housing 202 into the chamber portion 222 through the port 236. Although FIG. 2 shows a single port 236 extending through the housing wall 204, the housing 202 may comprise a plurality of ports 236 distributed circumferentially around the housing 202 at or near the uphole end of the chamber portion 215 to fluidly connect the space external to the housing 202 with the chamber volume 222. A flow restrictor 237 may be disposed in one or more of the plurality of the ports 236.

The impact tool 200 further comprises a shaft 240 fixedly connected with the piston 220 and at least partially positioned within the chamber 214. The piston 220 and shaft 240 assembly may extend between and connect the housing 202 and, thus, the uphole end 206 of the downhole tool 200 with the downhole end 210 of the impact tool 200 to connect or maintain connection between the uphole and downhole tool string portions 112, 114. The piston 220 and shaft 240 assembly may be axially movable within the chamber 214 and, thus, axially movable with respect to the housing 202. The shaft 240 may extend out of the housing 202 at a downhole end of the housing 202 and may be is fixedly coupled with the downhole mechanical interface 212. A stop section 242 of the housing 202 may retain the piston 220 within the chamber 214 and fluidly seal against the shaft 240 to isolate the chamber volume 224 from the space external to the housing 202. The stop section 242 may comprise a central opening to permit the shaft 240 to axially move through the stop section 242 and a fluid seal 244 to permit the shaft 240 to slidably move through the stop section 242 while preventing fluid located external to the housing 202 from leaking into the chamber volume 224. Accordingly, the piston 220 and shaft 240 assembly may function as a sealing member or device operable to fluidly isolate the chamber volume 224 from the pressure and wellbore fluid within the space external to the impact tool 200.

A downhole portion or end of the piston 220 may comprise an impact feature 221, which may be implemented as an outwardly extending radial surface, shoulder, boss, flange, and/or another impact member. The impact feature 221 may impact or collide with a corresponding impact feature 243, which may be implemented as an inwardly extending radial shoulder, boss, flange, and/or another impact member integral to or otherwise carried by an uphole portion of the stop section 242. Although the impact features 221, 243 are described as being integral to or carried by the piston 220 and the stop section 242, respectively, it is to be understood that the impact features 221, 243 may be integral to or carried by other portions of the impact tool 200. For example, the impact feature 221 may be integral to or carried by the shaft 240, while the impact features 243 may be integral to or carried by other portions of the housing 202.

FIG. 2 shows the impact tool 200 in a retracted or untriggered position, in which the impact tool 200 comprises a minimum overall length measured between the uphole and downhole ends 206, 210 of the impact tool 200. In such position, which is referred to hereinafter as a first position, the piston 220 is located at the uphole end of the chamber 214, such that the piston portion 230 is fully disposed within the chamber portion 217 and the shaft 240 is retracted into the housing 202. The triggering or release mechanism 250 may be provided to latch, hold, or otherwise maintain the piston 220 and shaft 240 in the first position with respect to the housing 202 until the release mechanism 250 is triggered to permit the relative motion between the piston 220 and housing 202 and, thus, permit the impact features 221, 243 to collide.

An example release mechanism 250 may include a latching member, such as a bolt 252, connecting the piston 220 with the housing 202 in the first position. The bolt 252 may comprise a head 254 retained in position against a shoulder or another portion of the housing 202 and a body or shank 255 connected to the piston 220. The shank 255 may extend through an aperture 257 in the housing 202 and may be connected to the piston 220. The bolt 252 may comprise an explosive charge for severing or splitting the bolt 252 and, thus, releasing the piston 220 from the housing 202. A switch 256 may be electrically connected with the bolt 252 via a conductor 258 and utilized to detonate the explosive charge (not shown) within the bolt 252. The switch 256 may be an addressable switch, such as may be operated from the wellsite surface 104 by the power and control system 150 via electrical conductors, including the electrical conductors 113, 117 extending between the power and control system 150 and the switch 256. If multiple impact tools 200 are included within the tool string 110 for creating multiple impacts, addressable switches 256 may permit each of the multiple impact tools 200 to be triggered sequentially and/or independently. The switch 256 may also be or comprise a timer, such as may activate or trigger the release mechanism 250 at a predetermined time. The switch 256 may be battery powered to permit the release mechanism 250 to be triggered without utilizing the electrical conductors extending to the wellsite surface 104. Although the switch 256 is shown and described above as being configured for wired communication, it is to be understood that the switch 256 may be configured for wireless communication with a corresponding wireless device located at the wellsite surface 104 or another portion of the tool string 110. Such wireless switch 256 may permit the release mechanism 250 to be triggered from the wellsite surface without utilizing the electrical conductors 113, 117 extending to the wellsite surface 104.

Although not depicted in FIGS. 2-4, it is to be understood that the impact tool 200 may comprise a continuous bore or pathway extending longitudinally through the various components of the impact tool 200, including the housing 202, the piston 220, and the shaft 240. The bore may accommodate or receive therethrough the electrical conductor 117. One or more portions of the electrical conductor 117 may be coiled within the bore or the one or more open spaces within the housing 202, such as may permit the electrical conductor 117 to expand in length as the length of the impact tool 200 expands during impact operations.

Prior to being conveyed into the wellbore 102, the impact tool 200 may be configured to the first position such that the chamber volume 224 is formed and isolated from the space external to the housing 202. The pressure within the chamber volumes 224, 234 may then be equalized with the atmospheric pressure at the wellsite surface 104. However, if additional impact force is intended to be delivered by the impact tool 200, air may be drawn or evacuated from the chamber volume 224 to reduce the pressure within the chamber volume 224 resulting in a larger pressure differential across the piston 220. Similarly, if a smaller impact force is intended to be delivered by the impact tool 200, air may be pumped into the chamber volume 224 to increase the pressure within the chamber volume 224 resulting in a smaller pressure differential across the piston 220 and, thus, a decrease in the amount of stored energy downhole. The uphole end 206 of the impact tool 200 may then be connected with the uphole portion 112 of the tool string 110 and the downhole end 210 may be connected with the downhole portion 114 of the tool string 110. Once the impact tool 200 is configured and coupled to the tool string 110, the tool string 110 may be conveyed into the wellbore 102 to a predetermined depth or position to perform the intended wellbore operations.

As the tool string is conveyed downhole, the hydrostatic pressure in the wellbore 102 external to the housing 202 of the impact tool 200 increases. However, as the chamber volume 224 is fluidly isolated from the chamber volume 222 and, thus, from the wellbore 102, the pressure within the chamber volume 224 remains substantially constant or otherwise appreciably lower than the ambient wellbore pressure throughout the conveyance operations. Similarly to the chamber volume 224, the chamber volume 234 may also be fluidly isolated from the chamber volume 224 and the wellbore 102 to maintain a substantially constant or otherwise appreciably lower pressure within the chamber volume 234 as the tool string 110 is conveyed downhole. Accordingly, when the tool string 110 reaches the predetermined depth or position within the wellbore 102, the pressure within the chamber volume 222 is appreciably greater than the pressures within the chamber volumes 224, 234 resulting in a net pressure differential across the piston 220 that urges or otherwise facilitates movement of the piston 220 in the downhole direction.

A net downhole piston force may be determined by calculating the difference between a downhole force exerted on the piston 220 and an uphole force exerted on the piston 220. The downhole force is determined by multiplying the pressure within the chamber volume 222 by an uphole face area 270 of the piston portion 226 and by multiplying the pressure within the chamber volume 234 by the uphole face area 274 of the piston portion 230. The uphole force is determined by multiplying the pressure within the chamber volume 224 by the downhole face area 272 of the piston portion 226 and by multiplying the pressure within the wellbore 102 by a cross-sectional area of the shaft 240. The net downhole force generated by the wellbore fluid on the piston 220 while in the first position may be appreciably reduced by fluidly isolating the chamber volume 234 from the chamber volume 222 and, thus, fluidly isolating the downhole face area 274 of the piston portion 230 from the pressurized wellbore fluid within the chamber volume 222. Accordingly, the net downhole force exerted on the bolt 252 of the release mechanism 250 is also appreciably reduced to help maintain the impact tool 200 in the first position when the tool string 110 reaches the predetermined depth or position within the wellbore 102.

If the tool string 110 becomes stuck in the wellbore 102 such that it is intended to deliver an impact to the tool string 110, the impact tool 200 may be activated, such as by operating the release mechanism 250, to impart the impact to the tool string 110 and dislodge the tool string 110. The impact tool 200 may progress though a sequence of operational stages or positions to release the energy stored in the impact tool 200 and impart the impact to the tool string 110. FIGS. 3 and 4 are schematic views of the impact tool 200 shown in FIG. 2 in subsequent stages of impact operations according to one or more aspects of the present disclosure.

FIG. 3 shows the impact tool 200 shortly after the release mechanism 250 was triggered to detonate the explosive bolt 252 to sever or split the bolt 252 and, thus, unlatch or disconnect the piston 220 from the housing 202. Once the piston 220 is free, the fluid pressure within the chamber volume 222 causes relative motion between the piston 220 and the housing 202. If the stuck portion of the tool string 110 is the uphole portion 112 of the tool string 110 or another portion located uphole from the impact tool 200, then the piston 220, the shaft 240, and the downhole portion 114 of the tool string 110 will move in the downhole direction with respect to the housing 202 and the stuck uphole portion 112 of the tool string 110. However, if the stuck portion of the tool string 110 is the downhole portion 114 or another portion of the tool string 110 located downhole from the impact tool 200, than the housing 202 and the uphole portion 112 of the tool string 110 will move in the uphole direction with respect to the piston 220, the shaft 240, and the stuck downhole portion 114 of the tool string 110.

The piston 220 and the housing 202 will continue to move with respect to each other until the piston portion 230 exits the chamber portion 217, at which point the chamber volumes 222, 234 are no longer fluidly isolated and both of the face areas 270, 274 are exposed to the wellbore pressure. In such position, the wellbore fluid located in the chamber volume 222 is free to flow into the chamber volume 234 and into contact with the downhole face area 274 of the piston portion 230 resulting in additional downhole force being exerted on the piston 220. The additional downhole force, in turn, increases the rate of acceleration and velocity between the piston 220 and the housing 202. The position of the impact tool 200 shown in FIG. 3 is referred to hereinafter as a second impact tool position.

The wellbore fluid will continue to flow into the united chamber volumes 222, 234 through the one or more ports 236, perhaps in a controlled manner by utilizing one or more flow restrictors 237 or plugs (not shown) to control the relative speed between the piston 220 and the housing 202. The piston 220 and/or the housing 202 will continue to move with respect to each other until the impact features 221, 243 impact or collide together to suddenly decelerate the moving portions of the tool string 110, imparting the impact to the stuck portion of the tool string 110. FIG. 4 shows the impact tool 200 in the impact position, referred to hereinafter as a third impact tool position, when the piston 220 reaches the end of stroke and the impact features 221, 243 come into contact.

Figure 5:
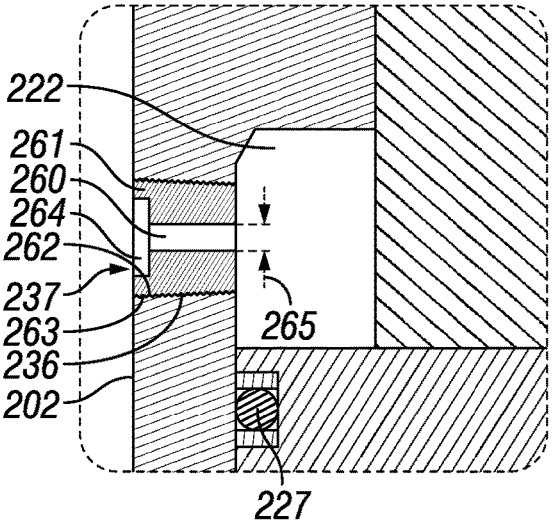
FIG. 5 is an enlarged view of a portion of the apparatus shown in FIG. 2.
Figure 6:
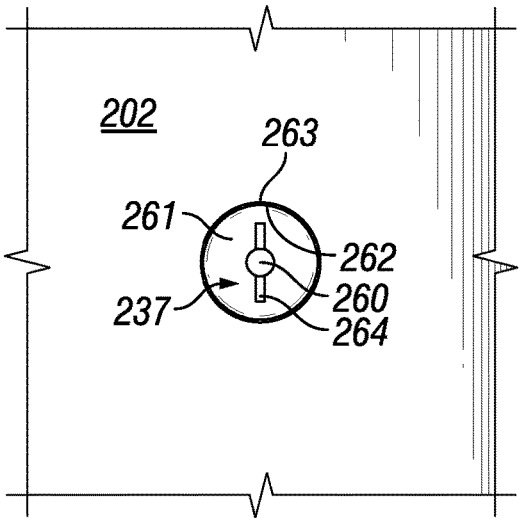
FIG. 6 is an enlarged side view of a portion of the apparatus shown in FIG. 2.

FIGS. 5 and 6 are enlarged and side views, respectively, of a portion of the impact tool 200 shown in FIG. 2, depicting an example implementation of the flow restrictor 237 disposed within the port 236 according to one or more aspects of the present disclosure. For example, the flow restrictor 237 may comprise a needle valve, a metering valve, a ball valve, or a flow limiter, such as may contain one or more orifices 260 extending therethrough. The flow restrictor 237 may comprise a body 261 having a substantially cylindrical configuration and external threads 262, such as may threadedly engage with corresponding internal threads 263 of the housing port 236. The flow restrictor 237 may also comprise a slot 264 or a shaped cavity partially extending into the body 261, such as may be operable in conjunction with a hand-tool, wrench, and/or other tool to rotate and threadedly engage the flow restrictor 237 within the port 236. The orifice 260 may have a cross-sectional area that is appreciably smaller than the cross-sectional area of the port 236.

The orifice 260 may have a predetermined cross-sectional area or an adjustable cross-sectional area. For example, the flow restrictor 237 may comprise an adjustable plunger or a needle (not shown) extending along or into the orifice 260, wherein the needle or the plunger may progressively open and close the cross-sectional area of the orifice 260. The flow restrictor 237 may comprise a single orifice 260 or multiple orifices (not shown), which may permit an increased flow rate through the flow restrictor 237. The orifice 260 may also comprise a different cross-sectional shape, such as a circle, an oval, a rectangle, or another shape. The flow restrictor 237 may by fixedly disposed within or about the port 236 by means other than threaded engagement. For example, the flow restrictor 237 may comprise or be utilized in conjunction with a flange (not shown), such as may permit the flow restrictor 237 to be bolted to the housing 202 about the port 236. The flow restrictor 237 may also comprise or be utilized in conjunction with a filter or a permeable material (not shown) disposed within or about the orifice 260, such as may filter or otherwise prevent contaminants from flowing into the chamber volume 222.

Before or after being coupled to the tool string 110, the impact tool 200 may be configured to generate and/or impart a predetermined impact force to the tool string 110 based on, for example, depth of the tool string 110 within the wellbore 102, weight of the tool string 110, and wellbore fluid properties, such as viscosity. The magnitude of the intended impact may also depend on structural strength or resiliency of the tool string 110 to withstand the impact forces. Knowing such operational parameters may permit a surface operator to predict the velocity of the piston 220 and, thus, adjust the one or more flow restrictors 237 to adjust the velocity of the piston 220 as intended. For example, the impact tool 200 may be configured by selecting and installing proper flow restrictors 237, such as may cause the impact tool 200 to generate and deliver the predetermined impact force. As a flow rate through an opening is proportional to a diameter and/or cross-sectional area of such opening, the rate at which the wellbore fluid flows into the chamber volume 222 may be controlled by appropriately selecting the orifice diameter 265 of the flow restrictor 237. Since the wellbore fluid is substantially incompressible, reducing the rate of flow of the wellbore fluid into the impact tool 200 may reduce the rate of speed at which the piston 220 and shaft 240 assembly and the housing 202 move with respect to each other, which in turn, may reduce the magnitude of the impact to the tool string 110.

The magnitude of the impact force may be configured by, for example, adjusting the orifice size 265 of the one or more flow restrictors 237 by operating the needle or the plunger to progressively open or close the cross-sectional area of the orifice 260 of one or more flow restrictors 237. Flow restrictors 237 comprising different preset sizes and/or configurations may be utilized in the impact tool 200 based on the operational parameters. For example, flow restrictors 237 having different orifice diameters 265 and/or cross-sectional areas may be utilized interchangeably to control the magnitude of the impact. For example, the diameter 265 of the orifice 260 may be about 1/16 in (about 1.6 mm), about 1/8 in (about 3.2 mm), about 1/4 in (about 6.4 mm), or about 3/8 in (about 9.5 mm), and the cross-sectional area of the orifice 260 may be about 0.003 $in^2$ (about 1.98 $mm^2$), about 0.012 $in^2$ (about 7.92 $mm^2$), about 0.049 $in^2$ (about 31.7 $mm^2$), or about 0.110 $in^2$ (about 71.2 $mm^2$). However, other dimensions are also within the scope of the present disclosure.

Instead of or in addition to utilizing the flow restrictors 237, the flow rate at which the wellbore fluid enters the chamber volume 222 may be controlled by closing some of the ports 236 to prevent flow through the closed ports 236 in order to control a cumulative flow area (i.e., open area) of the ports 236. For example, one or more of the ports 236 may be blocked or closed off by one or more plugs (not shown) threadedly engaged or otherwise disposed within one or more of the ports 236. Furthermore, if multiple impact tools 200 are included within the tool string 110 for creating multiple impacts, the magnitude of the impact force imparted by each impact tool 200 may be controlled or adjusted independently. For example, the flow restrictors 237 or plugs may be utilized to set an increasing impact force schedule, wherein each subsequent impact force imparted by each subsequent impact tool 200 increases until the tool string 110 is set free.

In addition to utilizing one or more flow restrictors 237 or plugs, the magnitude of the impact may also be controlled by adjusting the cumulative uphole area 270, 274 of the piston 220. In other words, because the net downhole force exerted on the piston 220 may be related to the total uphole face area 270, 274 exposed to the wellbore pressure and the downhole face area 272 exposed to the air or gas pressure within the chamber volume 224, the net downhole force applied to the piston 220 may be controlled by adjusting the inner diameter 216 of the chamber portion 215, the outer diameter 232 of the piston portion 226, and/or an outer diameter 241 of the shaft 240. The magnitude of the impact may also be controlled by adjusting travel distance (i.e., the stroke distance) of the piston 220 to adjust the distance over which the piston 220 accelerates.

Figure 7:
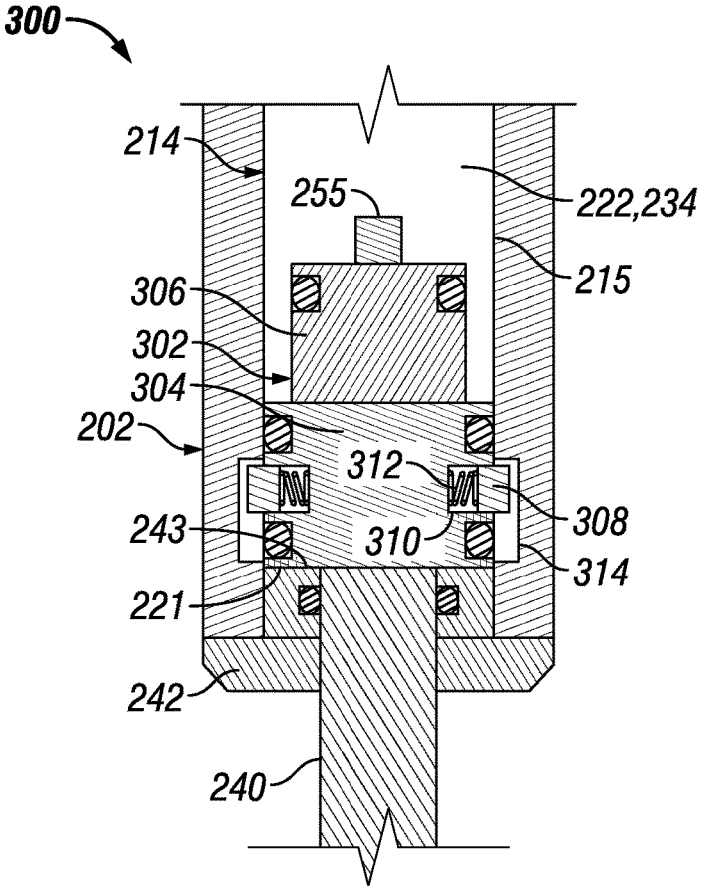
FIG. 7 is an enlarged view of a portion of an example implementation of the apparatus shown in FIG. 4.

FIG. 7 is an enlarged view of a portion of an example implementation of the impact tool 200 shown in FIG. 4 according to one or more aspects of the present disclosure, and designated in FIG. 7 by reference numeral 300. The impact tool 300 depicted in FIG. 7 is in the third impact tool position and is substantially similar in structure and operation to the impact tool 200 depicted in FIG. 4, including where indicated by like reference numbers, except as described below. The following description refers to FIGS. 1, 4, and 7, collectively.

The impact tool 300 may comprise a piston 302 slidably disposed within the chamber portion 215. The piston 302 may include a piston portion 304 sealingly disposed against a wall of the chamber portion 215 and a piston portion 306 sealingly disposable against a wall of the chamber portion 217. The release mechanism 250 within the scope of the present disclosure may not permit or otherwise facilitate re-coupling between the piston 220 and the housing 202 while in the first position. Accordingly, the impact tool 300 may also comprise a means for locking or otherwise maintaining the impact tool 300 in the third position. The locking means may include one or more latches 308 disposed within corresponding cavities 310 or other spaces extending radially into the piston portion 304. Each latch 308 may be radially movable within the corresponding cavity 310 and biased in a radially outward direction by a corresponding biasing member 312 disposed within the cavity 310 and against the latch 308. The biasing members 312 may comprise coil springs, leaf springs, gas springs, wave springs, spring washers, torsion springs, or other means.

During impact operations of the impact tool 300, as the piston 302 and the housing 202 move with respect to each other, the latches 308 may be maintained at least partially retracted within the cavities 310 by the wall of the chamber portion 215. When the impact features 221, 243 approach each other, the latches 308 may extend radially outwards into corresponding cavities 314 or spaces in the wall of the chamber portion 215 at or near a downhole end of the chamber portion 215. Once the latches 308 are inserted within the corresponding cavities 314, the piston 302 and the housing 202 may be locked in a relative position, such as may prevent the shaft 240 from retracting or collapsing into the housing 202 if the impact tool 300 is axially compressed during subsequent downhole impact or other operations. For example, if additional impact tools 300 are included within the tool string 110 for creating additional impacts, locking the piston 302 and housing 202 may permit a subsequent impact force to be transmitted through the locked impact tool 300 to a stuck portion of the tool string 110. However, if the cylinder 302 and the housing 202 of the triggered impact tool 300 are permitted to move relative to each other, the triggered impact tool 300 may absorb the impact forces (e.g., similarly to a spring or shock absorber) and/or not transfer the impact force to the stuck portion of the tool string 110.

Figure 8:
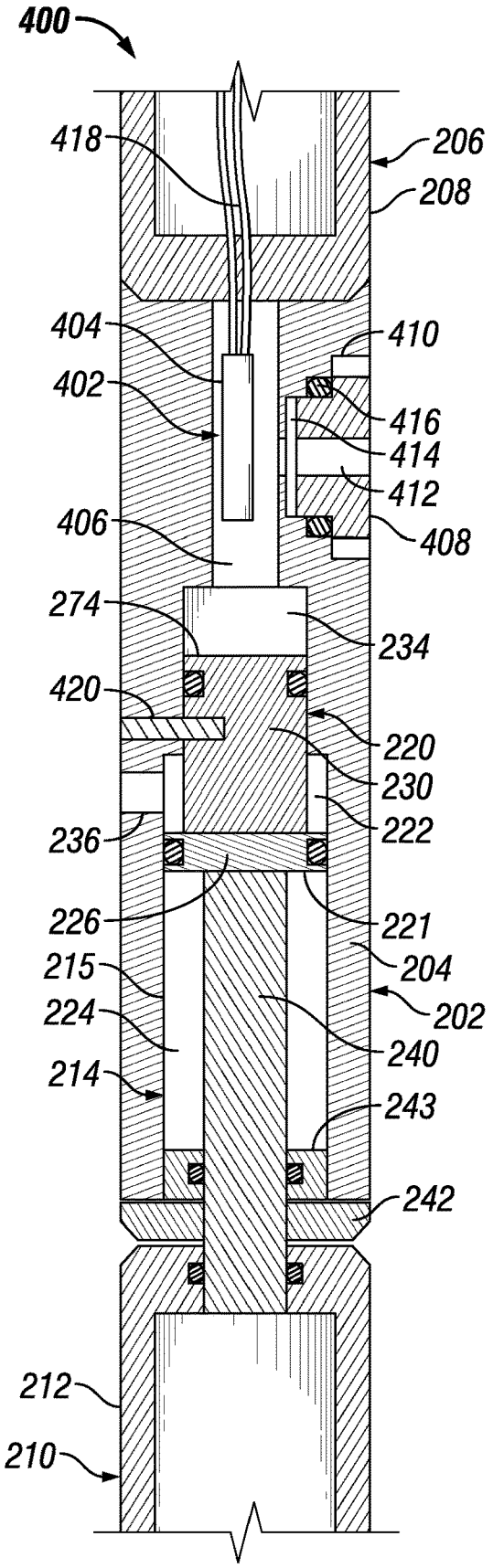
FIG. 8 is a schematic view of a portion of another example implementation of the apparatus shown in FIG. 2 according to one or more aspects of the present disclosure.

FIG. 8 is a schematic view of an example implementation of the impact tool 200 shown in FIG. 2 according to one or more aspects of the present disclosure, and designated in FIG. 8 by reference numeral 400. The impact tool 400 depicted in FIG. 8 is in the first impact tool position and is substantially similar in structure and operation to the impact tool 200, including where indicated by like reference numbers, except as described below. The following description refers to FIGS. 1 and 8, collectively.

The impact tool 400 may include a piston release mechanism 402 comprising a detonator 404 or another explosive device disposed within a fluid pathway 406 extending longitudinally through a portion of the housing 202. The fluid pathway 406 may be fluidly connected with the chamber volume 234. The release mechanism 402 may further comprise a rupture disk 408 threadedly or otherwise retained within a fluid port 410 extending through the wall 204 of the housing 202. The rupture disk 408 may include an orifice 412 extending through the rupture disk 408 operable to fluidly connect the space external to the housing 202 with the fluid pathway 406. The orifice 412 may be closed by a fluid-blocking membrane or plate 414, such as may prevent fluid from flowing through the orifice 412. A fluid seal 416 may be included between the port 410 and the rupture disk 408, such as may prevent or reduce fluid leakage between the port 410 and the rupture disk 408. The fluid-blocking plate 414 may be ruptured or otherwise opened to permit fluid flow through the orifice 412 when the fluid-blocking plate 414 is subjected to a pressure differential that exceeds a predetermined threshold. The detonator 404 may be electrically connected with the switch 256 via one or more leads 418 and detonated by the power and control system 150 from the wellsite surface 104.

A shear pin 420 may be utilized to lock the piston 220 against the housing 202 to maintain the piston 220 in the first position. The shear pin 420 may prevent relative movement between the piston 220 and housing 202 while being urged to move by the wellbore fluid located in the chamber volume 222. When the detonator 404 is detonated, a pressure wave generated by the detonator 404 may rupture the fluid-blocking plate 414 to permit the wellbore fluid to flow through the orifice 412 into the fluid pathway 406 and into the chamber volume 234. Accordingly, when the face area 274 of the piston 220 becomes exposed to the wellbore pressure, the net force exerted against the piston 220 increases, shearing or otherwise breaking the shear pin 420 to permit the piston 220 and the housing 202 to move relative to each other to trigger the impact, as described above.

The orifice 412 of the rupture disk 408 may be relatively narrow compared to inner diameter of the port 236. Accordingly, the orifice 412 may function as a pilot port for permitting the pressure in the chamber volume 234 to increase to trigger the impact tool 400. Once the piston 220 reaches the second position, the port 236 may permit an increased flow of the wellbore fluid into the combined chamber volumes 222, 234, causing the speed between the piston 220 and the housing 202 to increase. Although the port 236 is shown without the flow restrictor 237 disposed therein, it is to be understood that the flow restrictor 237 may be utilized to control the flow rate of the wellbore fluid into the impact tool 400, as described above.

Furthermore, it is to be understood that the port 236 may be omitted from the housing 202 and the orifice 412 of the rupture disk 408 may be solely utilized to communicate the wellbore fluid into the impact tool 400. In such implementations, the rupture disk 408 and the orifice 412 may be larger or sized accordingly to permit a fluid flow rate into the combined chamber volumes 222, 234 that is sufficient to facilitate an impact between the impact features 221, 243. If the port 236 is omitted, the shear pin 420 may also be omitted, as the piston 220 is not biased in the downhole direction by the wellbore pressure while the piston 220 is in the first position. Also, if the piston 220 is not biased in the downhole direction until the release mechanism 602 is activated, the piston 220 may comprise a single diameter, such as by omitting the piston portion 230.

Figure 9:
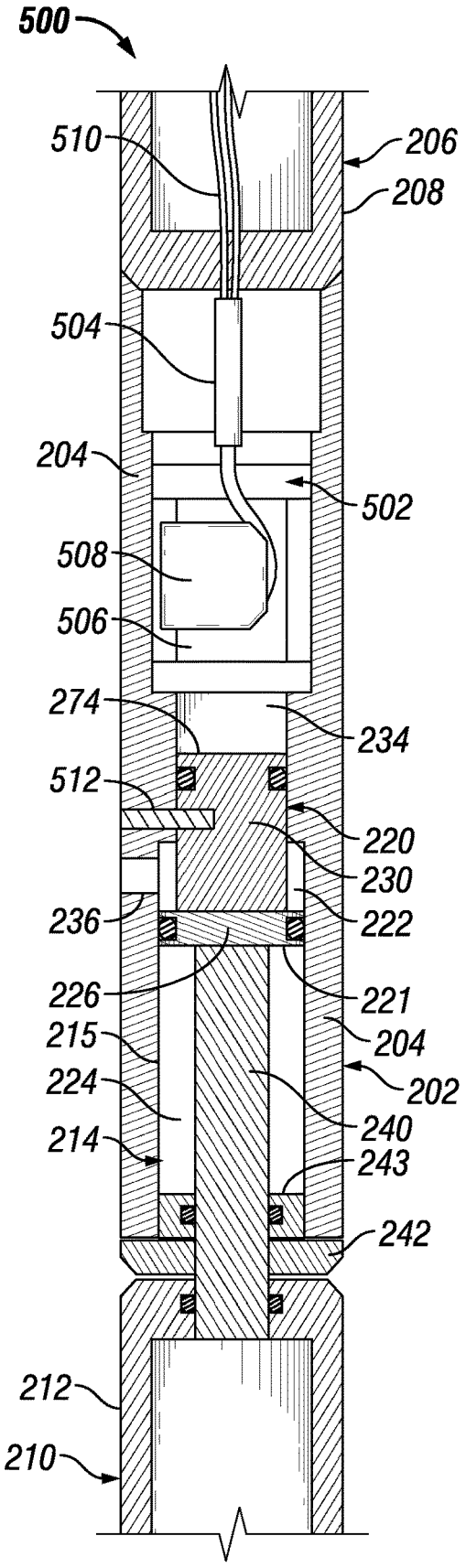
FIG. 9 is a schematic view of another example implementation of the apparatus shown in FIG. 2 according to one or more aspects of the present disclosure.

FIG. 9 is a schematic view of another example implementation of the impact tool 200 shown in FIG. 2 according to one or more aspects of the present disclosure, and designated in FIG. 9 by reference numeral 500. The impact tool 500 depicted in FIG. 9 is in the first impact tool position and is substantially similar in structure and operation to the impact tool 200, including where indicated by like reference numbers, except as described below. The following description refers to FIGS. 1 and 9, collectively.

The impact tool 500 may include a piston release mechanism 502 comprising a detonator 504 or another explosive device disposed within a fluid pathway 506 extending longitudinally through a portion of the housing 202. The fluid pathway 506 may be fluidly connected with the chamber volume 234. The release mechanism 502 may further comprise a shaped charge 508 disposed within the fluid pathway 506 for perforating the wall 204 of the housing 202 when detonated. The detonator 404 may be electrically connected with the switch 256 via one or more leads 510 and detonated by the power and control system 150 from the wellsite surface 104.

A shear pin 420 may be utilized to lock the piston 220 against the housing 202 to maintain the piston 220 in the first position. The shear pin 420 may prevent relative movement between the piston 220 and housing 202 while being urged to move by the wellbore fluid located in the chamber volume 222. The detonation of the detonator 504 may cause the shaped charge 508 to detonate and, thus, perforate the wall 204 of the housing 202 along the fluid pathway 506 to fluidly connect the space external to the housing 202 with the fluid pathway 506. Accordingly, the perforation may permit the pressurized wellbore fluid to flow into the fluid pathway 506 and into the chamber volume 234 against the downhole face area 274 of the piston portion 230 to increase the net force exerted on the piston 220 in the downhole direction. The increased force may shear or otherwise break the shear pin 512 to permit the piston 220 and the housing 202 to move relative to each other to trigger the impact, as described above.

The perforation formed by the shaped charge 508 may be relatively narrow compared to the inner diameter of the port 236. Accordingly, the perforation may function as a pilot port for permitting the pressure in the chamber volume 234 to increase to trigger the impact tool 500. Once the piston 220 reaches the second position, the port 236 may permit an increased flow into the combined chamber volumes 222, 234, causing the speed between the piston 220 and the housing 202 to increase. Although the port 236 is shown without the flow restrictor 237 disposed therein, it is to be understood that the flow restrictor 237 may be utilized to control the flow rate of the wellbore fluid into the impact tool 500, as described above.

Furthermore, it is to be understood that the port 236 may be omitted from the housing 202. In such implementations, multiple shaped charges 508 may be utilized to form multiple perforations in the wall 204 of the housing 202 to permit a fluid flow rate into the combined chamber volumes 222, 234 that is sufficient to facilitate an impact between the impact features 221, 243. If the port 236 is omitted, the shear pin 512 may also be omitted, as the piston 220 is not biased in the downhole direction by the wellbore pressure while the piston 220 is in the first position. Also, if the piston 220 is not biased in the downhole direction until the release mechanism 602 is activated, the piston 220 may comprise a single diameter, such as by omitting the piston portion 230.

Figure 10:
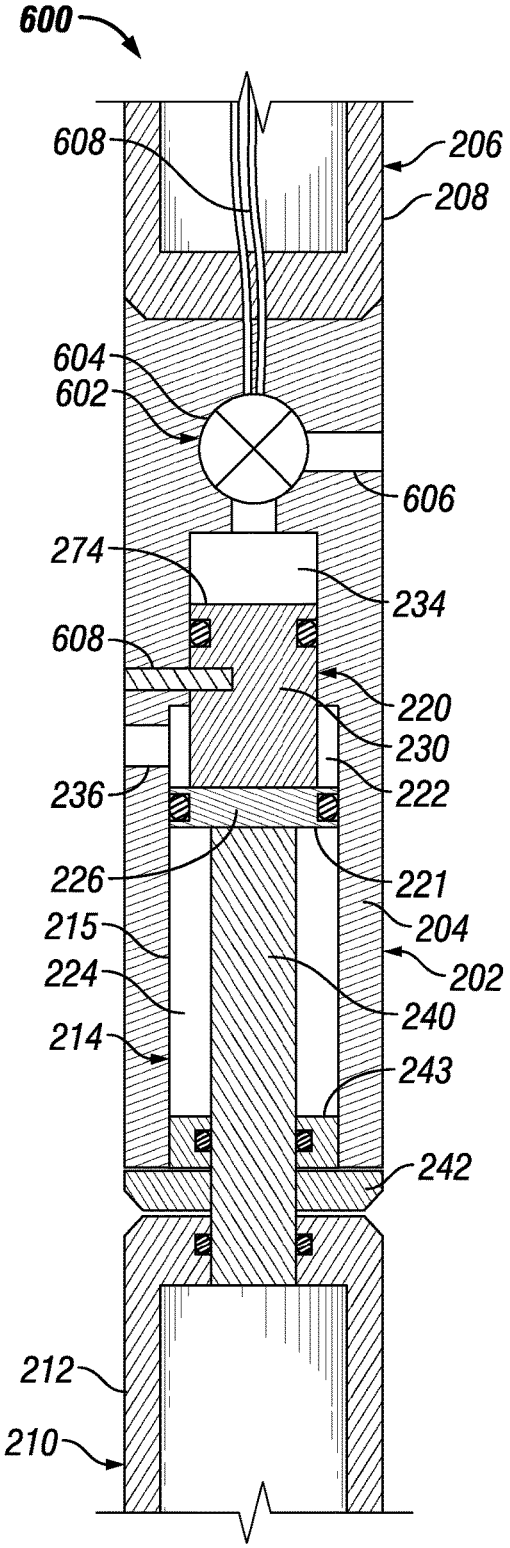
FIG. 10 is a schematic view of another example implementation of the apparatus shown in FIG. 2 according to one or more aspects of the present disclosure.

FIG. 10 is a schematic view of another example implementation of the impact tool 200 shown in FIG. 2 according to one or more aspects of the present disclosure, and designated in FIG. 10 by reference numeral 600. The impact tool 600 depicted in FIG. 10 is in the first impact tool position and is substantially similar in structure and operation to the impact tool 200, including where indicated by like reference numbers, except as described below. The following description refers to FIGS. 1 and 10, collectively.

The impact tool 600 may include a piston release mechanism 602 comprising a hydraulic valve 604 disposed along a fluid pathway 606 extending through the wall 204 of the housing 202 and fluidly connecting the space external to the housing 202 and the chamber volume 234. The hydraulic valve 604 may be or comprise a spool valve, a butterfly valve, a globe valve, or another valve operable to shift between a closed and an open position to selectively permit fluid flow therethrough. The hydraulic valve 604 may be actuated by an electrical actuator (not shown), such as a solenoid or an electrical motor, or by other means. The electrical actuator may be electrically connected via one or more leads 608 with the electrical conductor 117, such as may permit the hydraulic valve 604 to be actuated by the power and control system 150 from the wellsite surface 104.

A shear pin 420 may be utilized to lock the piston 220 against the housing 202 to maintain the piston 220 in the first position. The shear pin 420 may prevent relative movement between the piston 220 and the housing 202 while being urged to move by the wellbore fluid located in the chamber volume 222. When the hydraulic valve 604 is actuated, the wellbore fluid is permitted to flow through the fluid pathway 606 into the chamber volume 234 against the downhole face area 274 of the piston portion 230 to increase the net force exerted on the piston 220 in the downhole direction. The increased force may shear or otherwise break the shear pin 608 to permit the piston 220 and the housing 202 to move relative to each other to trigger the impact, as described above.

Similarly as described above, the hydraulic valve 604 may comprise an orifice (not shown) which may be relatively narrow compared to the inner diameter of the port 236. Accordingly, the hydraulic valve 604 may operate as a pilot valve, permitting the pressure in the chamber volume 234 to increase to trigger the impact tool 600. Once the piston 220 reaches the second position, the port 236 may permit an increased flow into the combined chamber volumes 222, 234, causing the speed between the piston 220 and the housing 202 to increase. Although the port 236 is shown without the flow restrictor 237 disposed therein, it is to be understood that the flow restrictor 237 may be utilized to control the flow rate of the wellbore fluid into the impact tool 600, as described above.

Furthermore, it is to be understood that the port 236 may be omitted from the housing 202 and the hydraulic valve 604 may be utilized to communicate the wellbore fluid into the impact tool 600. In such implementations, the orifice of the hydraulic valve 604 may be larger or sized accordingly to permit a fluid flow rate into the combined chamber volumes 222, 234 that is sufficient to facilitate an impact between the impact features 221, 243. If the port 236 is omitted, the shear pin 608 may also be omitted, as the piston 220 is not biased in the downhole direction by the wellbore pressure while the piston 220 is in the first position. Also, if the piston 220 is not biased in the downhole direction until the release mechanism 602 is activated, the piston 220 may comprise a single diameter, such as by omitting the piston portion 230.

Figure 11:
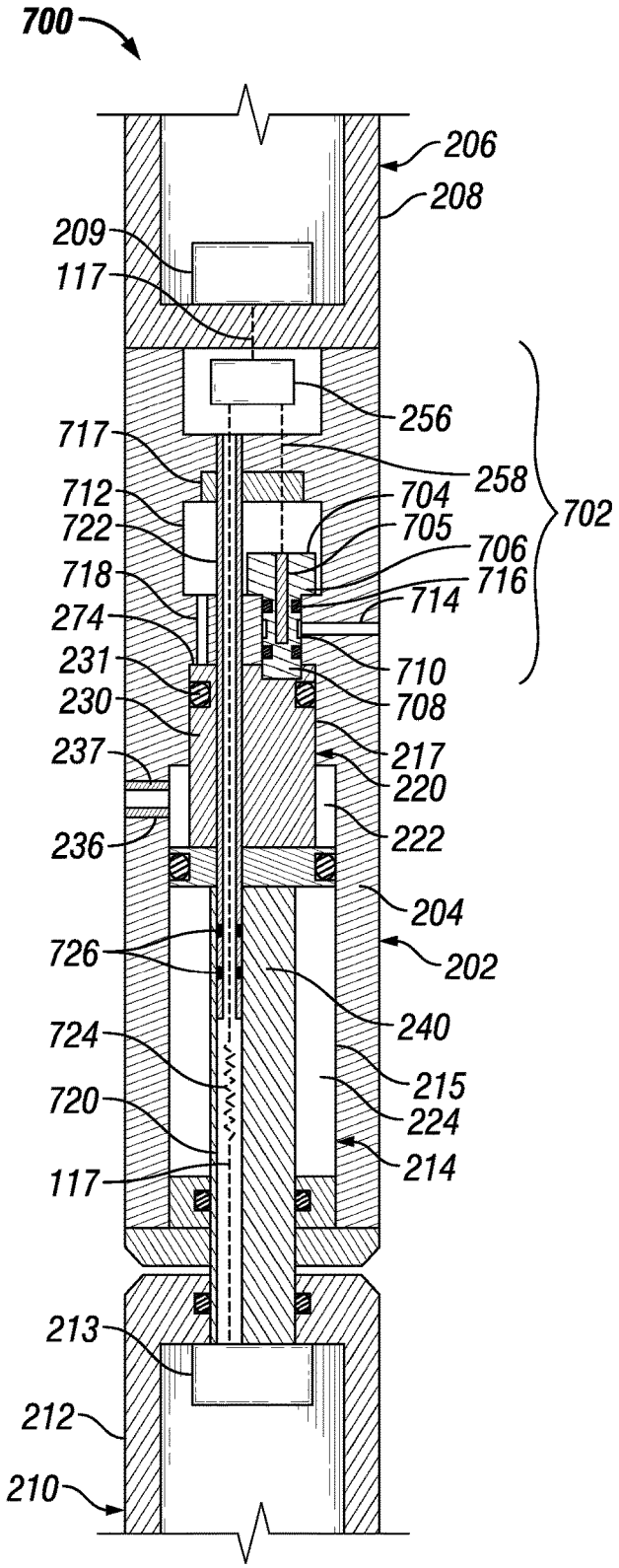
FIG. 11 is a schematic view of another example implementation of the apparatus shown in FIG. 2 according to one or more aspects of the present disclosure.

FIG. 11 is a schematic view of another example implementation of the impact tool 200 shown in FIG. 2 according to one or more aspects of the present disclosure, and designated in FIG. 11 by reference numeral 700. The impact tool 700 depicted in FIG. 11 is in the first impact tool position and is substantially similar in structure and operation to the impact tool 200, including where indicated by like reference numbers, except as described below. The following description refers to FIGS. 1 and 11, collectively.

The impact tool 700 may comprise a piston release mechanism 702 having the switch 256 and a latching member, such as a bolt 704, which may latch or otherwise couple the piston 220 with the housing 202 of the impact tool 700. The bolt 704 may contain an explosive charge 705, which when detonated, may sever or split the bolt 704 to release or disconnect the piston 220 from the housing 202. The switch 256 may be electrically connected with the charge 705 via the conductor 258 and utilized to detonate the explosive charge 705 as described above.

The impact tool 700 may further include a chamber 712 fluidly connected with the chamber portion 217 via a pathway or bore 710 extending between the chamber 712 and the chamber portion 217. The bolt 704 may comprise a head 706 and a body or shank 708. The shank 708 may extend through the bore 710 such that the head 706 is disposed against a shoulder or another portion of the housing 202 around the bore 710 while a downhole portion of the shank 708 may be connected with the piston 220, such as via a threaded connection. Accordingly, the bolt 704 may couple the piston 220 with the housing 202 to maintain the piston 220 in its first position with respect to the housing 202.

An orifice or port 714 may extend through the housing wall 204 to fluidly connect the space external to the impact tool 700 with the bore 710. When the impact tool 700 is conveyed within the wellbore 102, the port 714 may permit wellbore fluid to flow into or be in fluid communication with the chamber 712 and/or the chamber portion 217 during impact operations. The bolt 704 may include fluid seals 716, such as O-rings or cup seals, along the shank 708 to fluidly isolate the chamber 712 and the chamber portion 217 from the wellbore fluid located within the port 714 and a portion of the bore 710 extending between the fluid seals 716. A flow restrictor (not shown) similar to the flow restrictor 237 described above, may be disposed within the port 714 to reduce or otherwise control the rate of fluid flow through the port 714.

The chamber 712 and the chamber portion 217 may also be fluidly connected via a bore 718 extending between the chamber 712 and chamber portion 217. The bore 718 may permit pressure equalization between the chamber 712 and the uphole face area 274 of the piston 220. Accordingly, because the chamber 712 and the chamber portion 217 uphole from the seals 231 are fluidly isolated from the wellbore fluid, the chamber 712 and the top portion of the piston 220 may be maintained at atmospheric pressure or a pressure that is appreciably lower than the wellbore pressure as the impact tool 700 is conveyed downhole to help maintain the piston 220 in its retracted position.

The impact tool 700 may further comprise a continuous bore or pathway 720 extending longitudinally through various components of the impact tool 700, such as the chamber 712, the housing 202, the piston 220, and the shaft 240. The pathway 720 may accommodate or receive a hollow shaft or another tubular member 722, which may house therein at least a portion of the electrical conductor 117 extending between electrical interfaces 209, 213. The tubular member 722 may be fixedly coupled with the housing 202 or another portion of the impact tool 700, such as may permit the tubular member 722 to remain static with respect to the piston 220 and the shaft 240 during impact operations. The tubular member 722 may include one or more fluid seals 726, such as O-rings or cup seals, which may help maintain atmospheric pressure within the chamber 712 and/or prevent or reduce wellbore fluid from leaking through the pathway 720 around the tubular member 722. The tubular member 722 may protect the electrical conductor 117 from the pressure wave and/or high velocity particles formed by the charge 705 during detonation. The tubular member 722 may also maintain the electrical conductor 117 within the pathway 720 as the housing 202 or the piston 220 and shaft 240 assembly move during impact operations. One or more portions of the electrical conductor 117 may be coiled 724 within the pathway 720 or the tubular member 722, such as may permit the electrical conductor 117 to expand in length as the length of the impact tool 700 expands during the impact operations.

A pressure damper 717 may surround portions of the electrical conductor 258 and/or the tubular member 722. The pressure damper 717 may be operable to dampen pressure spikes caused by the detonation of the explosive charge 705. The pressure damper 717 may yield to absorb at least a portion of the energy released by the detonation and/or form a seal against the tubular member 722 and the electrical conductor 258 to prevent the pressure spike from reaching the switch 256, the electrical interface 209, and/or other components located along the electrical conductors 117, 258. The pressure damper 717 may comprise rubber, polyether ether ketone (PEEK), silicone, viton, potting material, and/or other damping material.

Figure 12:
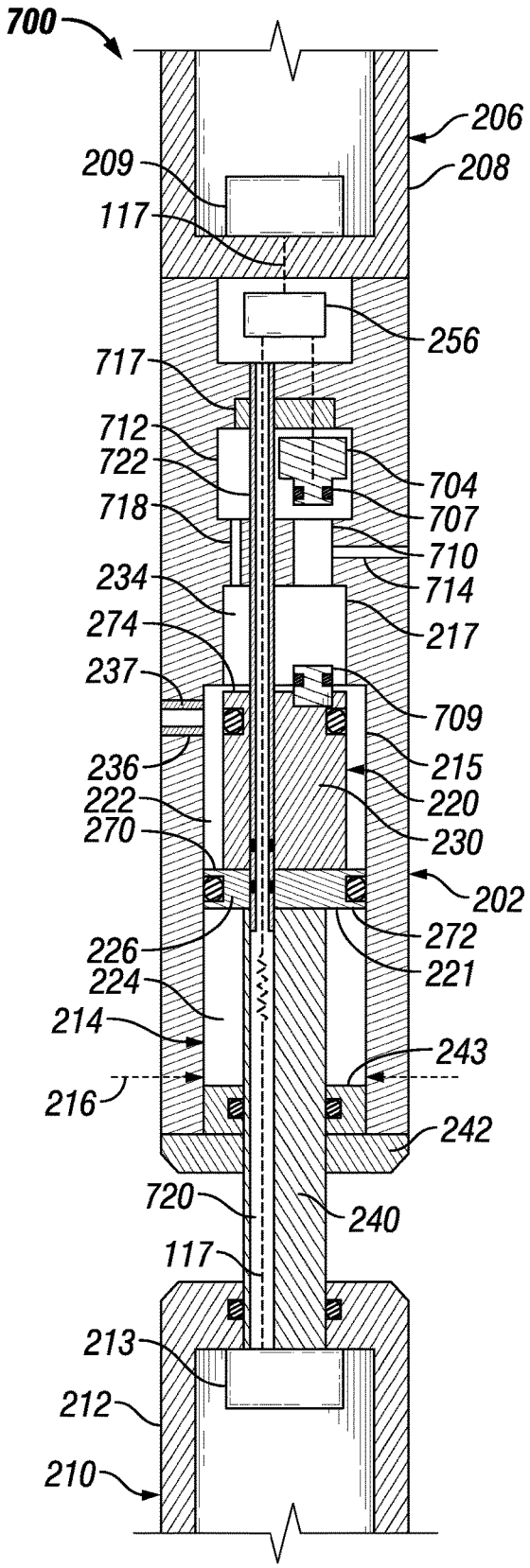
FIG. 12 is a schematic view of the apparatus shown in FIG. 11 at different stage of operation.
Figure 13:
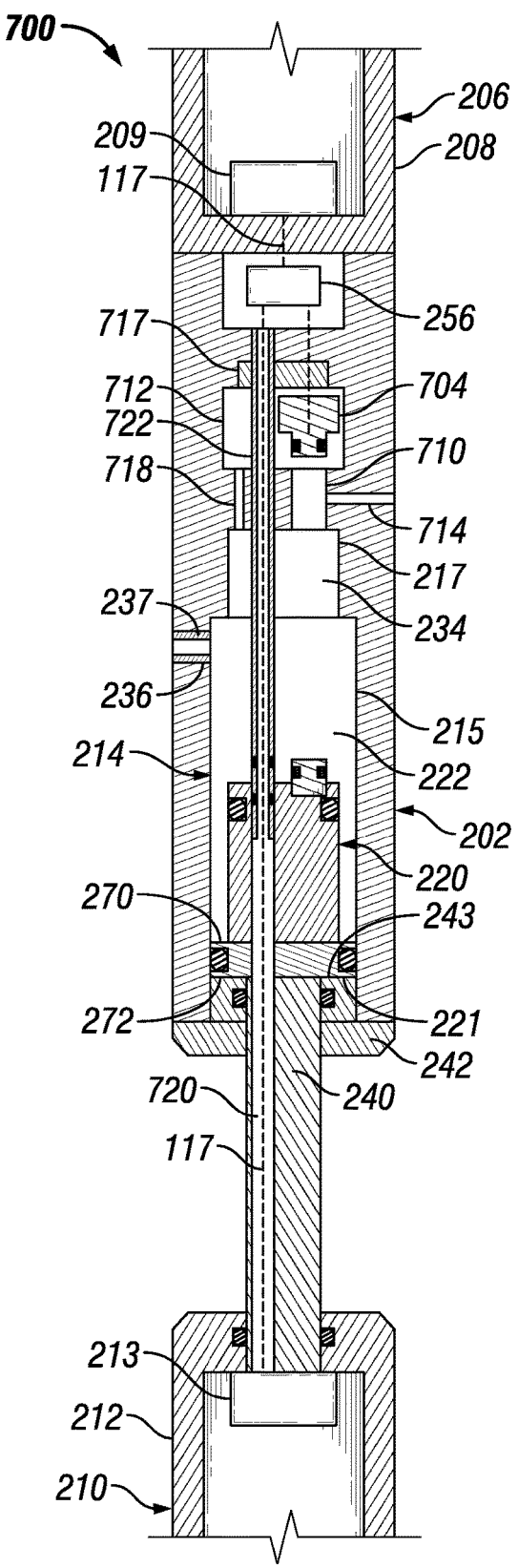
FIG. 13 is another schematic view of the apparatus shown in FIGS. 11 and 12 at different stage of operation.

If the tool string 110 becomes stuck in the wellbore 102 such that it is intended to deliver an impact to the tool string 110, the impact tool 700 may be operated to impart the impact to the stuck portion of the tool string 110 to dislodge the tool string 110. The impact tool 700 may progress though a sequence of operational stages or positions to release the energy stored in the impact tool 700 and impart the impact to the tool string 110. FIGS. 12 and 13 are schematic views of the impact tool 700 shown in FIG. 11 in subsequent stages of operation according to one or more aspects of the present disclosure. The following description refers to FIGS. 1 and 11-13, collectively.

FIG. 12 shows the impact tool 700 in a second position shortly after the release mechanism 702 was triggered to detonate the charge 705 to sever or split the bolt 704 into portions 707, 709 and, thus, unlatch or disconnect the piston 220 from the housing 202. Once the bolt 704 severs, the wellbore fluid at ambient downhole pressure may flow between the portions 707, 709 of the bolt 704 and force the portion 707 into the chamber 712, which may be at atmospheric pressure. The wellbore fluid may then flow into the chamber 712 and against the uphole face area 274 of the piston 220 via the bore 718 to initiate or otherwise permit relative motion between the piston 220 and the housing 202. The downhole fluid may also flow into the chamber 712 and against the uphole face area 274 of the piston 220 via the bore 710 once the portion 709 of the bolt 704 exits the bore 710. Relative velocity between the piston 220 and the housing 202 may be limited by the flow rate of the wellbore fluid through the port 714 and, thus, by the size of the port 714. If the stuck portion of the tool string 110 is the uphole portion 112 of the tool string 110 or another portion located uphole from the impact tool 700, then the piston 220, the shaft 240, and the downhole portion 114 of the tool string 110 will move in the downhole direction with respect to the housing 202, the tubular member 722, and the stuck portion of the tool string 110. However, if the stuck portion of the tool string 110 is the downhole portion 114 or another portion of the tool string 110 located downhole from the impact tool 700, than the housing 202, the tubular member 722, and the uphole portion 112 of the tool string 110 will move in the uphole direction with respect to the piston 220, the shaft 240, and the stuck portion of the tool string 110.

The piston 220 and the housing 202 will continue to move with respect to each other until the piston portion 230 exits the chamber portion 217 and enters the chamber portion 215. In such position, the movement of the piston 220 may no longer be limited by the flow rate permitted by the port 714, as the one or more ports 236 may permit additional wellbore fluid to flow into the united chamber volumes 222, 234 to increase the relative velocity between the piston 220 and the housing 202. While the piston 220 and the housing 202 continue to move with respect to each other, the tubular member 722 and the piston 220 may also continue to move with respect to each other.

The wellbore fluid will continue to flow into the united chamber portions 215, 217 through the ports 236, perhaps in a controlled manner by utilizing one or more flow restrictors 237 or plugs (not shown), as described above. The piston 220 and/or the housing 202 will continue to move with respect to each other until the impact features 221, 243 impact or collide together to suddenly decelerate the moving portion of the tool string 110, imparting an impact to the stuck portion of the tool string 110, as described above. FIG. 13 shows the impact tool 700 in the impact or third position, when the piston 220 reaches the end of stroke and the impact features 221, 243 impact or collide together.

Figure 14:
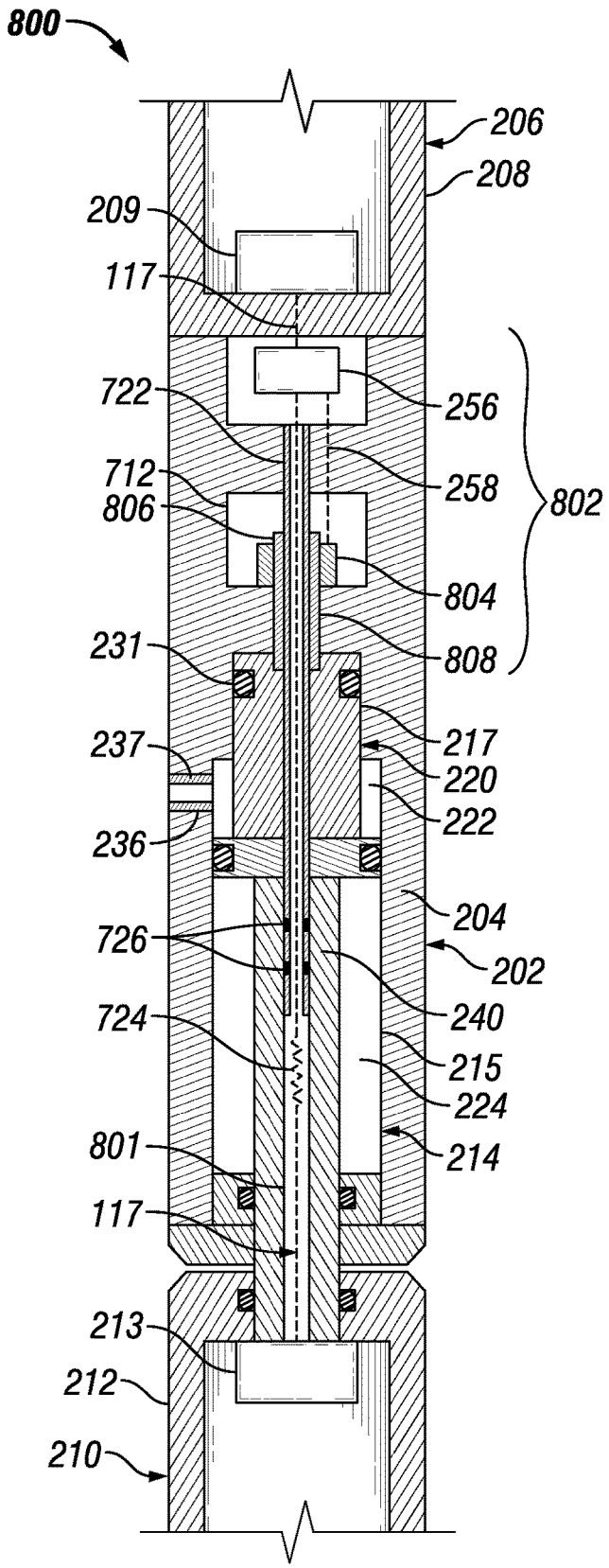
FIG. 14 is a schematic view of another example implementation of the apparatus shown in FIG. 11 according to one or more aspects of the present disclosure.

FIG. 14 is a schematic view of an example implementation of the impact tool 700 shown in FIG. 11 according to one or more aspects of the present disclosure, and designated in FIG. 14 by reference numeral 800. The impact tool 800 depicted in FIG. 14 is in the first impact tool position and is substantially similar in structure and operation to the impact tool 700, including where indicated by like reference numbers, except as described below. The following description refers to FIGS. 1 and 14, collectively.

The impact tool 800 may comprise a continuous bore or pathway 801 extending longitudinally through various components of the impact tool 800, such as the chamber 712, the housing 202, the piston 220, and the shaft 240. The pathway 801 may accommodate the tubular member 722, which may house therein at least a portion of the electrical conductor 117 extending between electrical interfaces 209, 213. However, unlike in the impact tool 700, the pathway 801 and the tubular member 722 may extend along the center of the piston 220 and the shaft 240.

The impact tool 800 may further include a piston release mechanism 802 comprising a frangible nut 804 threadedly or otherwise fixedly connected with a tubular member 806, which may be threadedly or otherwise fixedly connected with the piston 220. The tubular member 806 may traverse a bore 808 extending between the chamber 712 and the chamber portion 217. The nut 804 may be disposed against a shoulder or another portion of the housing 202 to latch the piston 220 with the housing 202. The nut 804 may include an explosive charge (not shown), which may be detonated by the switch 256 to sever or split the nut 804 and/or the tubular member 806 to release or disconnect the piston 220 from the housing 202. Although the nut 804 and the tubular member 806 are shown disposed about the tubular member 722, the tubular member 722 may protect the electrical conductor 117 to permit signal communication between the opposing electrical interfaces 209, 213 during and after the impact operations.

If the tool string 110 becomes stuck in the wellbore 102 such that it is intended to deliver an impact to the tool string 110, the impact tool 800 may be activated to impart the impact to the stuck portion of the tool string 110 and dislodge the tool string 110. The impact tool 800 may progress though a sequence of operational stages or positions to release the energy stored in the impact tool 800 and impart the impact to the tool string 110, similarly to as described above.

The impact tools 200, 300, 400, 500, 600, 700, 800 described herein and shown in FIGS. 2-14 are oriented such that the shaft 240 extends from the housing 202 in the downhole direction. However, it is to be understood that the orientation of the impact tools 200, 300, 400, 500, 600, 700, 800 within the tool string 110 may be reversed, such that the impact tool end 210 is coupled with the uphole portion 112 of the tool string 110 and the impact tool end 206 is coupled with the downhole portion 114 of the tool string 110, without affecting the operation of the impact tools 200, 300, 400, 500, 600, 700, 800.

Referring again to FIG. 1, another example implementation of the pressure differential downhole tool 116 within the scope of the present disclosure may be or comprise a disconnecting or release tool, such as may be operable to selectively uncouple, disconnect, part, or otherwise release the uphole and downhole portions 112, 114 of the tool string 110 from each other while conveyed within the wellbore 102. The release tool within the scope of the present disclosure may utilize pressure differential between internal and external portions of the release tool to separate or help separate uphole and downhole portions of the release tool and, thus, separate or help separate the uphole and downhole portions 112, 114 of the tool string 110.

Figure 15:
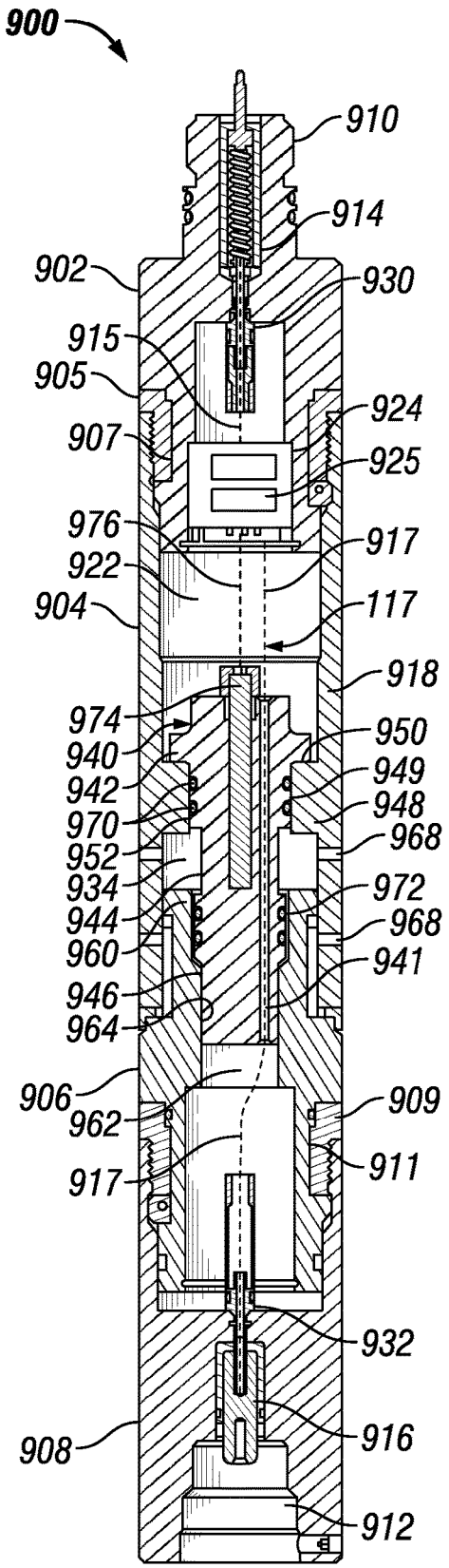
FIG. 15 is a sectional view of at least a portion of an example implementation of apparatus according to one or more aspects of the present disclosure.
Figure 16:
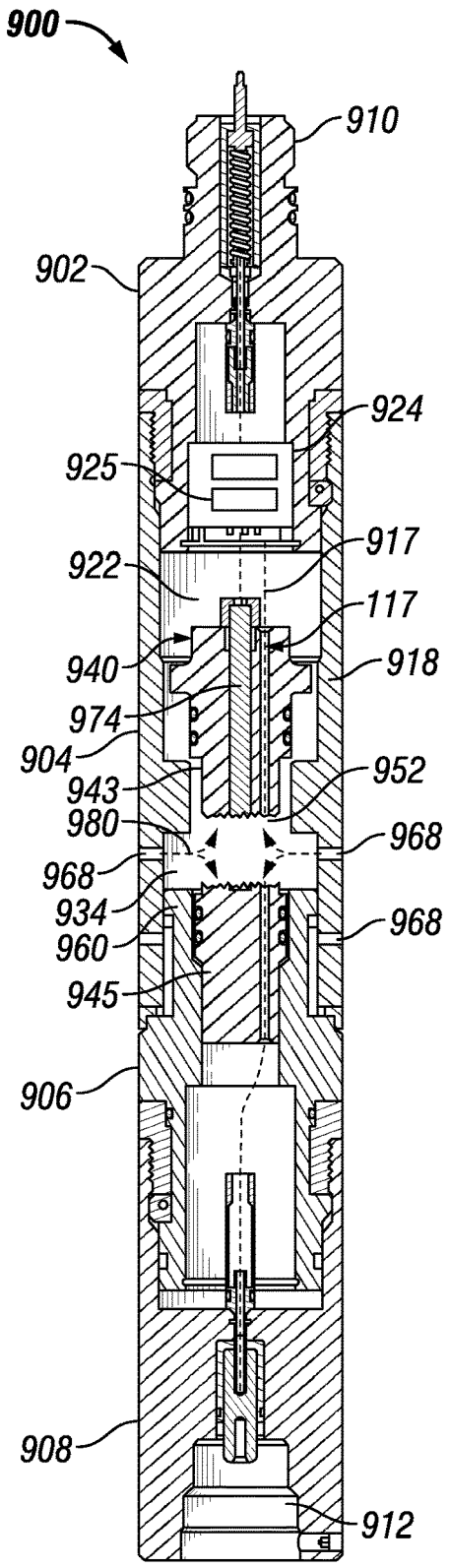
FIG. 16 is a sectional view of the apparatus shown in FIG. 15 at different stage of operation.
Figure 17:
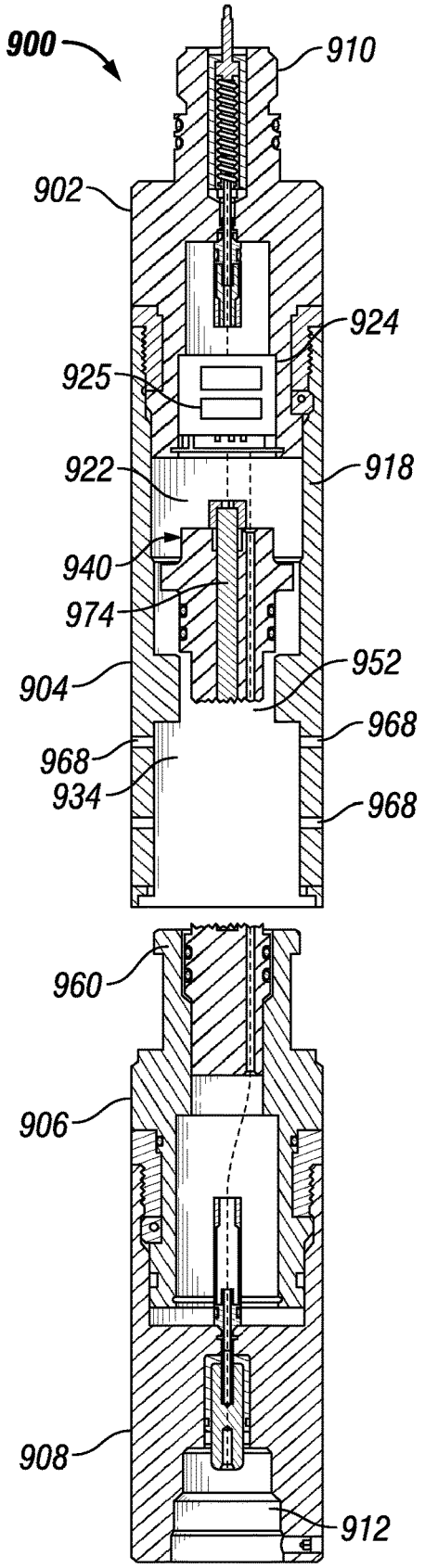
FIG. 17 is another sectional view of the apparatus shown in FIGS. 15 and 16 at different stage of operation.

FIGS. 15-17 are schematic views of at least a portion of the pressure differential downhole tool 116 shown in FIG. 1 implemented as a release tool according to one or more aspects of the present disclosure and designated in FIGS. 15-17 by reference numeral 900. FIGS. 15-17 show the release tool 900 at different stages of impact operations. The following description refers to FIGS. 1 and 15-17, collectively.

While conveyed within the wellbore 102, the release tool 900 may permit the downhole portion 114 of the tool string 110 coupled downhole from the release tool 900 to be left in the wellbore 102 while the uphole portion 112 of the tool string 110 coupled uphole from the release tool 900 may be retrieved to the wellsite surface 104. For example, if a portion of the tool string 110 is intended to be left in the wellbore 102, the release tool 900 may be operated downhole to separate and, thus, release a portion of the tool string 110, which may then be retrieved to the wellsite surface 104. Also, if a portion of the tool string 110 is stuck within the wellbore 102 and an impact tool, such as the impact tool 200, is unable to free it, the release tool 900 may be operated to release the free portion of the tool string 110 coupled uphole from the release tool 900 from the stuck portion of the tool string 110, such that the unstuck portion of the tool string 110 may be retrieved to the wellsite surface 104.

The release tool 900 may include an uphole head 902, a removable section 904, a remaining section 906, and a downhole head 908, each having or defining one or more internal spaces, volumes, and/or bores for accommodating or otherwise containing various components of the release tool 900, including one or more electrical conductors extending through the release tool 900.

The uphole and downhole heads 902, 908 of the release tool 900 may include interfaces, subs, and/or other means for mechanically and electrically coupling the release tool 900 with corresponding mechanical and electrical interfaces (not shown) of the impact tool 200, the uphole and downhole portions 112, 114, or other portions of the tool string 110. The uphole head 902 may include a mechanical interface, a sub, and/or other means 910 for mechanically coupling the release tool 900 with a corresponding mechanical interface (not shown) of the uphole portion 112 or another portion of the tool string 110 uphole from the release tool 900. The downhole head 908 may include a mechanical interface, a sub, and/or other means 912 for mechanically coupling with a corresponding mechanical interface (not shown) of the downhole portion 114 or another portion of the tool string 110 downhole from the release tool 900. Although the interface means 910, 912 are shown comprising an ACME pin and box couplings, respectively, the interface means 910, 912 may comprise other pin and box couplings, threaded connectors, fasteners, and/or other mechanical coupling means.

The uphole interface means 910 and/or other portion of the uphole head 902 may further include an electrical interface 914 comprising means for electrically connecting an electrical conductor 915 extending through the uphole head 902 with a corresponding electrical interface (not shown) of a portion of the tool string 110 uphole from the release tool 900, whereby the corresponding electrical interface may be in electrical connection with the electrical conductor 113 of the uphole tool string portion 112. The downhole interface means 912 and/or other portion of the downhole head 908 may include an electrical interface 916 comprising means for electrically connecting an electrical conductor 917 extending through the downhole head 908 with a corresponding electrical interface (not shown) of a portion of the tool string 110 downhole from the release tool 900, whereby the corresponding electrical interface may be in electrical connection with one of the electrical conductor 115 of the downhole tool string portion 114. Although the electrical interfaces 914, 916 are shown comprising a pin and a receptacle, respectively, the electrical interfaces 914, 916 may each comprise other electrical coupling means, including plugs, terminals, conduit boxes, and/or other electrical connectors.

Each of the uphole and downhole heads 902, 908 may further comprise additional bulkhead connectors 930, 932 facilitating a fluid seal along the electrical conductors 915, 917, such as to prevent or reduce the wellbore fluid or other external fluids from leaking into internal portions of the release tool 900 around the electrical conductors 915, 917.

The uphole head 902 may be threadedly or otherwise coupled with a housing 918 of the removable section 904 to mechanically connect the removable section 904 with the uphole head 902. For example, the housing 918 may threadedly engage a retaining collar 905, which may be disposed within a retaining groove 907 extending around a downhole portion of the uphole head 902. Similarly, the downhole head 908 may be threadedly or otherwise coupled with the remaining section 906 to mechanically connect the remaining section 906 with the downhole head 908. For example, the downhole head 908 may threadedly engage a retaining collar 909, which may be disposed within a retaining groove 911 extending around a downhole portion of the remaining section 906.

The uphole head 902 and/or an uphole portion of the removable section 904 may contain an electronics package 924, such as an electronics circuit board. The electronics package 924 may comprise various electronic components facilitating generation, reception, processing, recording, and/or transmission of electronic data. The electronics package 924 may also include a switch 925, which may comprise the same or similar structure and/or mode of operation as the switch 256 described above. The electronics package 924 may be electrically connected with or otherwise connected along the electrical conductors 915, 917 extending between the uphole and downhole electrical interfaces 914, 916, such as to permit communication of the electronic data and/or electrical power between the electronics package 924, the impact tool 200, the uphole and downhole portions 112, 114 of the tool string 110, and/or the surface equipment 140. The plurality of components, including the electrical conductors 915, 917, the bulkhead connectors 930, 932, the electrical interfaces 914, 916, and the electronics package 924 may collectively form the electrical conductor 117, such as may facilitate electrical communication with and/or through the release tool 900.

The removable section 904 may comprise an internal space or chamber 922 selectively isolated from the space external to the release tool 900. The removable section 904 may further comprise another internal space or chamber 934 open to or otherwise fluidly connected with the space external to the release tool 900. The chamber 922 may be selectively connected with the chamber 934 and, thus, the space external to the release tool 900 via a bore or passage 952 extending between the chambers 922, 934. The passage 952 may be defined by a circumferential protrusion or shoulder 948 extending inwardly from an inner surface of the housing 918. The passage 952 may be operable to receive a shaft, a bolt, or another fastener 940, such as may be utilized to couple the removable section 904 with the remaining section 906. The fastener 940 may include a head 942 and a shank 944, which may terminate with a connection portion 946 operable to couple with the remaining section 906. In an example implementation, the connection portion 946 may comprise external threads. A bore 941 may longitudinally traverse the fastener 940, such as may accommodate the electrical conductor 917 extending between the electronics package 924 and the electrical interface 916.

An uphole end of the remaining section 906 may comprise a fishing neck 960, such as may permit coupling with wellbore fishing equipment (not shown) during fishing operations. The remaining section 906 may further comprise an axial bore 962 extending longitudinally through the remaining section 906 and a connection portion 964 operable to couple with the connection portion 946 of the fastener 940. In an example implementation, the connection portion 964 may comprise internal threads operable to engage the external threads of the connection portion 946.

The fishing neck 960 may be at least partially disposed within the downhole chamber 934 of the removable section 904, such that the fishing neck 960 may be covered by the housing 918 or another portion of the removable section 904. The shank 944 of the fastener 940 may slidably engage an inner surface 949 of the shoulder 948 and may be slidably disposed within the passage 952 such that the head 942 abuts an uphole surface 950 of the shoulder 948. Furthermore, the connection portion 946 of the fastener 940 may be engaged with the connection portion 964 of the remaining section 906 to couple the remaining section 906 with the fastener 940 and, thus, with the housing 918 of the removable section 904. Although the fishing neck 960 is shown configured as an external fishing neck (i.e., comprising an outer diameter locating profile), it is to be understood that the fishing neck 960 may comprise other configurations, such as may be utilized in the oilfield industry, including an internal fishing neck (i.e., comprising an inner diameter locating profile).

As further shown in FIG. 15, a plurality of orifices or ports 968 may extend through the housing 918 to fluidly connect the space external to the release tool 900 with the chamber 934. The ports 968 may permit the pressure within the downhole chamber 934 and around the fishing neck 960 to equalize with the ambient wellbore pressure as the release tool 900 is conveyed within the wellbore 102. The ports 968 may also permit the wellbore fluid located external to the release tool 900 to flow into the downhole chamber 934 during separation operations, as described below. Thus, the fastener 940 may also be or operate as a sealing member to fluidly isolate the chamber 922 from the wellbore fluid and ambient wellbore pressure external to the release tool 900. The fastener may include fluid seals 970, such as O-rings or cup seals, along the shank 944 sealingly engaging the inner surface 949 of the shoulder 948 to prevent or reduce flow of the wellbore fluid into the chamber 922. The fastener 940 may include additional fluid seals 972, such as O-rings or cup seals, along the shank 944 sealingly engaging an inner surface of the remaining section 906 to fluidly isolate an inner portion of the remaining section 906 from the wellbore fluid located within the downhole chamber 934.

An explosive charge 974 may be disposed within the fastener 940, which when detonated, may sever or split the fastener 940 radially to release or disconnect the remaining section 906 from the removable section 904. The charge 974 may be detonated by the switch 925, which may be electrically connected with the charge 974 via an electrical conductor 976 and with the surface equipment 140 via electrical conductor 915.

FIG. 15 shows the release tool 900 in a first or inactivated position, in which the release tool 900 is utilized to transmit tension and/or compression generated by the tensioning device 130 at the wellsite surface 104 to a portion of the tool string 110 located downhole from the release tool 900, such as during conveyance of the tool string 110. In the first position, the release tool 900 may be further operable to transmit tension and/or compression generated by an impact tool 200 incorporated into the tool sting 110. In an example implementation, the release device 900 may be operable to withstand a tension of about 120,000 pounds or more. Accordingly, one or more release tools 900 may be coupled along the tool string 110 uphole and/or downhole from the impact tool 200. Coupling the release tool 900 downhole from the impact tool 200 permits the impact tool 200 to be recovered to the wellsite surface 104 if the impact tool 200 fails to free a stuck portion of the tool string 110.

As the tool string 110 is conveyed downhole along the wellbore 102, the hydrostatic pressure in the wellbore 102 external to the release tool 900 increases. However, the pressure within the chamber 922 remains substantially the same as the chamber 922 is fluidly isolated from the downhole chamber 934 and from the wellbore 102. Accordingly, when the tool string 110 reaches the predetermined depth or position within the wellbore 102, the pressure within the chamber 934 may be appreciably greater than the pressure within the chamber 922 resulting in a net pressure differential across at least a portion of the fastener 940 causing an internal tension along the shank 944 of the fastener 940.

If it is intended to release a portion of the tool string 110 coupled uphole from the release tool 900, the release tool 900 may be operated to disconnect the removable section 904 from the remaining section 906. The release tool 900 may progress though a sequence of operational stages or positions during such release operations. FIGS. 16 and 17 are sectional views of the release tool 900 shown in FIG. 15 in subsequent stages of release operations according to one or more aspects of the present disclosure. The following description refers to FIGS. 1 and 15-17, collectively.

FIG. 16 shows the release tool 900 in a second position shortly after the explosive charge 974 was detonated by the switch 925 to sever or split the fastener 940 into at least portions 943, 945 and, thus, unlatch or disconnect the remaining section 906 and the removable section 904 from each other. Once the fastener 940 severs or splits, the portion 943 of the fastener 940 is no longer restrained, permitting the force imparted on the portion 943 by the wellbore pressure to move the portion 943 in an uphole direction into the chamber 922 and permitting the wellbore fluid to flow into the chambers 934, 922, as indicated by arrows 980. The inrush of the wellbore fluid into the chambers 934, 922 may at least partially separate or help to separate the removable and the remaining sections 904, 906 away from each other.

Even if the explosive charge 974 does not by itself fully sever or split the fastener 940, the internal tension applied to the fastener 940 by the pressure differential between the wellbore pressure external to the release tool 900 and the pressure within the chamber 922 may be operable to separate the partially severed portions of the fastener 940. For example, when detonated, the explosive charge 974 may create a split, crack, or cavity extending into or at least partially through the shank 943 to increase surface area exposed to the wellbore pressure. Such additional surface area may become exposed to the wellbore pressure to increase the internal tension applied to the fastener 940. The split, crack, or cavity may also weaken the fastener 940 by decreasing the cross-sectional area of the shank 944 holding the upper and lower portions 934, 945 of the fastener 940 together. The increased tension and decreased cross-sectional area may increase internal stress along the shank 944, permitting the pressure differential to fully sever or separate the upper and lower portions 934, 945 and, thus, permit separation of the removable and remaining sections 904, 906.

When the fastener 940 is severed, tension may be applied by the tensioning device 130 at the wellsite surface 104 to the tool string 110 to move the uncoupled portion of the tool string 110 and the removable section 904 of the release tool 900 in the uphole direction to uncover the fishing neck 960 covered by the housing 918 of the removable section 904. Accordingly, the remaining section 906 of the release tool 900 left behind in the wellbore 102 may provide an exposed fishing neck 960 that may be engaged by wellbore fishing equipment (not shown), which may be conveyed downhole when the uncoupled portion of the tool string 110 is returned to the wellsite surface 104. The fishing equipment may be operable to locate and couple with the fishing neck 960 in order to retrieve the remaining stuck portion of the tool string 110. FIG. 17 shows the release tool 900 in the uncovered or third position, when the housing 918 is removed to uncover the fishing neck 960 for use during fishing operations.

In view of the entirety of the present disclosure, including the figures and the claims, a person having ordinary skill in the art will readily recognize that the present disclosure introduces an apparatus comprising an impact tool operable to be coupled between portions of a tool string conveyable within a wellbore extending into a subterranean formation, wherein the impact tool comprises: a housing; a chamber within the housing; a piston slidably disposed within the chamber and dividing the chamber into a first chamber volume and a second chamber volume, wherein the first chamber volume is open to a space external to the housing, wherein the second chamber volume is fluidly isolated from the space external to the housing, and wherein the piston is operable to be maintained in a predetermined position within the chamber to maintain pressure within the second chamber volume appreciably lower than pressure within the first chamber volume while the impact tool is conveyed along the wellbore; and a shaft connected with the piston and axially movable with respect to the housing.

While the impact tool is conveyed within the wellbore: an opening in the housing may permit the pressure within the first chamber volume to be maintained substantially equal to pressure within the space external to the housing thereby forming a pressure differential between the pressure within the first chamber volume and the pressure within the second chamber volume; the pressure differential may facilitate relative movement between the piston and housing; and the relative movement between the piston and housing may end with an impact between moving and stationary portions of the impact tool. The moving portion of the impact tool may comprise one of the housing and piston, and the stationary portion of the impact tool may comprise another of the housing and piston.

The pressure within the first chamber volume may be maintained substantially equal to hydrostatic wellbore pressure within the space external to the housing, and the pressure within the second chamber volume may be maintained substantially constant.

The pressure within the second chamber volume may be maintained substantially equal to atmospheric pressure at a wellsite surface from which the wellbore extends.

The piston may fluidly isolate the first chamber volume from the second chamber volume, and while the impact tool is conveyed within the wellbore: the piston may be releasable from the predetermined position to permit pressure differential between the pressure within the first chamber volume and the pressure within the second chamber volume to facilitate relative movement between the piston and housing; and the relative movement may end with an impact between moving and stationary portions of the impact tool imparting an impact force to the downhole tool string.

The impact tool may further comprise a mechanism operable to: maintain the piston in the predetermined position within the chamber; and release the piston to permit pressure differential between the pressure within the first chamber volume and the pressure within the second chamber volume to move the piston and housing relative to each other thereby permitting a moving portion of the impact tool to impact a stationary portion of the impact tool. The mechanism may comprise a bolt coupling the piston with the housing, and the bolt may comprise an explosive charge operable to sever the bolt to release the piston from the housing. The mechanism may comprise a fluid valve. The mechanism may be remotely operable from a wellsite surface from which the wellbore extends.

The housing may comprise one or more ports fluidly connecting the space external to the housing with the first chamber volume. The impact tool may further comprise a flow restrictor for controlling rate of fluid flow from the space external to the housing into the first chamber volume through the port.

The piston may further divide the chamber into a third chamber volume, the third chamber volume may be fluidly isolated from the second chamber volume and the space external to the housing, and pressure within the third chamber volume may be maintained appreciably lower than the pressure within the first chamber volume while the impact tool is conveyed along the wellbore. The piston may comprise a first piston portion having a first diameter and a second piston portion having a second diameter, the first diameter may be appreciably larger than the second diameter, the first piston portion may fluidly isolate the first chamber volume from the second chamber volume, and the second piston portion may fluidly isolate the first chamber volume from the third chamber volume. In such implementations, among others within the scope of the present disclosure, the impact tool may further comprise a mechanism operable to: maintain the piston in the predetermined position within the chamber; and fluidly connect the third chamber volume with the space external to the housing such that the pressure within the third chamber volume increases thereby permitting pressure differential between the pressure within the first chamber volume and the pressure within the second chamber volume to move the piston and housing relative to each other until a moving portion of the impact tool impacts against a stationary portion of the impact tool. The mechanism may be remotely operable from a wellsite surface from which the wellbore extends. The mechanism may comprise a fluid valve operable to shift between closed flow and open flow positions. The mechanism may comprise: a rupture disk in a wall of the housing; and an explosive device selectively operable to rupture the rupture disk. The mechanism may comprise an explosive device selectively operable to form an opening in a wall of the housing.

The impact tool may further comprise an electrical conductor extending from an uphole portion of the impact tool to a downhole portion of the impact tool. The electrical conductor may extend through the piston and the shaft. The impact tool may further comprise a tubular member extending at least partially through the piston and shaft, and the electrical conductor may extend within the tubular member.

The housing may be configured for connection with a first portion of the tool string and the shaft may be configured for connection with a second portion of the tool string.

The present disclosure also introduces an apparatus comprising an impact tool operable to be coupled between portions of a tool string conveyable within a wellbore extending into a subterranean formation, wherein the impact tool comprises: a housing; a chamber within the housing; a piston slidably disposed within the chamber and dividing the chamber into a first chamber volume and a second chamber volume, wherein the first chamber volume is open to a space external to the housing, and wherein the second chamber volume is fluidly isolated from the space external to the housing; a shaft connected with the piston and axially movable with respect to the housing; and a mechanism. The mechanism is operable to: maintain the piston in a predetermined position within the chamber; and release the piston to permit pressure differential between pressure within the first chamber volume and pressure within the second chamber volume to move the piston and housing relative to each other ending with an impact between moving and stationary portions of the impact tool.

While the impact tool is conveyed within the wellbore: an opening in the housing may permit the pressure within the first chamber volume to be maintained substantially equal to pressure within the space external to the housing; and the mechanism may be operable to maintain the piston in the predetermined position within the chamber to maintain pressure within the second chamber volume appreciably lower than the pressure within the first chamber volume thereby forming the pressure differential between the pressure within the first chamber volume and the pressure within the second chamber volume. The pressure within the first chamber volume may be maintained substantially equal to hydrostatic wellbore pressure within the space external to the housing, and the pressure within the second chamber volume may be maintained substantially constant. The pressure within the second chamber volume may be maintained substantially equal to atmospheric pressure at a wellsite surface from which the wellbore extends.

The moving portion of the impact tool may comprise one of the housing and piston, and the stationary portion of the impact tool may comprise another of the housing and piston.

The piston may fluidly isolate the first chamber volume from the second chamber volume.

The mechanism may comprise a bolt coupling the piston with the housing, and the bolt may comprise an explosive charge operable to sever the bolt to release the piston from the housing.

The mechanism may comprise a fluid valve.

The mechanism may be remotely operable from a wellsite surface from which the wellbore extends.

The housing may comprise one or more ports fluidly connecting the space external to the housing with the first chamber volume. The impact tool may further comprise a flow restrictor for controlling rate of fluid flow from the space external to the housing into the first chamber volume through the port.

The piston may further divide the chamber into a third chamber volume, the third chamber volume may be fluidly isolated from the second chamber volume and the space external to the housing, and pressure within the third chamber volume may be maintained appreciably lower than the pressure within the first chamber volume while the impact tool is conveyed along the wellbore. The piston may comprise a first piston portion having a first diameter and a second piston portion having a second diameter, the first diameter may be appreciably larger than the second diameter, the first piston portion may fluidly isolate the first chamber volume from the second chamber volume, and the second piston portion may fluidly isolate the first chamber volume from the third chamber volume. The mechanism may be operable to release the piston by fluidly connecting the third chamber volume with the space external to the housing such that the pressure within the third chamber volume increases thereby permitting the pressure differential to move the piston and housing relative to each other. The mechanism may be remotely operable from a wellsite surface from which the wellbore extends. The mechanism may comprise a fluid valve operable to shift between closed flow and open flow positions. The mechanism may comprise: a rupture disk in a wall of the housing; and an explosive device selectively operable to rupture the rupture disk. The mechanism may comprise an explosive device selectively operable to form an opening in a wall of the housing.

The impact tool may further comprise an electrical conductor extending from an uphole portion of the impact tool to a downhole portion of the impact tool. The electrical conductor may extend through the piston and the shaft. The impact tool may further comprise a tubular member extending at least partially through the piston and shaft, and the electrical conductor may extend within the tubular member.

The housing may be configured for connection with a first portion of the tool string and the shaft may be configured for connection with a second portion of the tool string.

The present disclosure also introduces a method comprising: (A) coupling an impact tool to a tool string, wherein the impact tool comprises: (1) a housing; (2) a chamber within the housing; (3) a piston slidably disposed within the chamber and dividing the chamber into a first chamber volume and a second chamber volume; and (4) a shaft connected with the piston and axially movable with respect to the housing; and (B) conveying the tool string within a wellbore while: (1) maintaining pressure within the first chamber volume substantially equal to pressure within space external to the housing; and (2) maintaining the piston in a predetermined position within the chamber to maintain pressure within the second chamber volume appreciably lower than the pressure within the first chamber volume thereby forming a pressure differential between the pressure within the first chamber volume and the pressure within the second chamber volume.

The method may further comprise operating the impact tool to permit the pressure differential to facilitate relative movement between the piston and housing resulting in an impact between a moving portion of the impact tool and a stationary portion of the impact tool. Operating the impact tool may comprise releasing the piston to permit the pressure differential to facilitate the relative movement between the piston and housing. Releasing the piston may comprise operating a fluid control valve. Operating the impact tool may comprise uncoupling the piston from the housing to permit the pressure differential to facilitate the relative movement between the piston and housing. Uncoupling the piston from the housing may comprise detonating an explosive charge to sever a latching member coupling the piston and the housing.

The pressure within the second chamber volume may be maintained substantially constant.

The pressure within the second chamber volume may be maintained substantially equal to atmospheric pressure at wellsite surface from which the wellbore extends.

The first chamber volume may be open to the space external to the housing, and the second chamber volume may be fluidly isolated from the first chamber volume and from the space external to the housing.

The housing may comprise a port fluidly connecting the space external to the housing with the first chamber volume, and the method may further comprise, before conveying the tool string within the wellbore, installing a flow restrictor into the port to control rate at which wellbore fluid flows into the first chamber volume.

The method may further comprise, before conveying the tool string within the wellbore, detachably coupling the piston and the housing to maintain the piston in the predetermined position within the chamber.

The present disclosure also introduces an apparatus comprising a downhole tool for connecting and selectively disconnecting within a wellbore first and second portions of a downhole tool string from each other, wherein the downhole tool comprises: a first connector sub connectable with the first portion of the downhole tool string; a second connector sub connectable with the second portion of the downhole tool string; an internal chamber; and a fastener connecting the first and second connector subs, wherein the fastener fluidly separates the internal chamber into a first chamber portion and a second chamber portion, wherein the first chamber portion is fluidly connected with a space external to the downhole tool, and wherein the downhole tool is selectively operable to disconnect the first and second connector subs from each other to disconnect the first and second portions of the downhole tool string from each other.

The first and/or second connector subs may at least partially define the internal chamber.

The first chamber portion may be fluidly connected with the space external to the downhole tool via a fluid port.

The fastener may contain an explosive charge selectively operable to detonate to sever the fastener and thus disconnect the first and second connector subs from each other.

The fastener may comprise: a first fastener portion connected with the first connector sub; and a second fastener portion connected with the second connector sub, wherein the downhole tool may be selectively operable to disconnect the first and second fastener portions from each other to thereby disconnect the first and second connector subs from each other. The fastener may be or comprise a bolt, the first fastener portion may be or comprise a shank of the bolt, and the second fastener portion may be or comprise a head of the bolt. The first fastener portion may be threadedly connected with the first connector sub. The second fastener portion may be latched against a shoulder of the second connector sub, and the second fastener portion may be movable within the internal chamber when the first and second fastener portions are disconnected from each other. While the downhole tool is conveyed within the wellbore, a port may permit wellbore fluid to flow into the first chamber portion from the wellbore thereby forming a pressure differential between pressure within the first chamber portion and pressure within the second chamber portion, and, after the first and second fastener portions are disconnected from each other, the pressure differential facilitates movement of the second fastener portion within the internal chamber to permit flow of the wellbore fluid into the second chamber portion.

While the downhole tool is conveyed within the wellbore: an opening in the downhole tool may permit pressure within the first chamber portion to be maintained substantially equal to pressure within the wellbore external to the downhole tool; and the fastener may fluidly isolate the second chamber portion from the first chamber portion to maintain pressure within the second chamber portion appreciably lower than the pressure within the first chamber portion thereby forming a pressure differential between the pressure within the first chamber portion and the pressure within the second chamber portion. While the downhole tool is conveyed within the wellbore, the pressure within the second chamber portion may be maintained substantially constant. While the downhole tool is conveyed within the wellbore, the pressure within the second chamber portion may be maintained substantially equal to atmospheric pressure at a wellsite surface from which the wellbore extends. While the downhole tool is conveyed within the wellbore, the pressure within the first chamber portion may be substantially equal to hydrostatic wellbore pressure external to the downhole tool.

While the downhole tool is conveyed within the wellbore, the fastener may block wellbore fluid from flowing into the second chamber portion.

The downhole tool may be selectively operable to disconnect the first portion of the downhole tool string from the second portion of the downhole tool string when the first portion of the downhole tool string becomes stuck within the wellbore to permit the second portion of the downhole tool string to be retrieved to a wellsite surface from which the wellbore extends.

One of the first and second connector subs may be at least partially inserted into another of the first and second connector subs.

The first connector sub may comprise a fishing neck.

The downhole tool may further comprise an electrical conductor extending between opposing ends of the downhole tool through the first and second connector subs.

The first portion of the downhole tool string may comprise a perforating tool, and the second portion of the downhole tool string may comprise a depth correlation tool.

The second portion of the downhole tool string may comprise a jarring tool operable to impart an impact to the downhole tool string.

The present disclosure also introduces an apparatus comprising a downhole tool for connecting and selectively disconnecting within a wellbore first and second portions of a downhole tool string from each other, wherein the downhole tool comprises: a first connector sub connectable with the first portion of the downhole tool string; a second connector sub connectable with the second portion of the downhole tool string, wherein the first and/or second connector subs at least partially define an internal chamber; and a fastener connecting the first and second connector subs and fluidly isolating the internal chamber from external space, wherein the fastener is separable into first and second fastener portions to disconnect the first and second connector subs and thereby disconnect the first and second portions of the downhole tool string from each other.

While the downhole tool is conveyed within the wellbore, the fastener may block wellbore fluid from flowing into the internal chamber.

While the downhole tool is conveyed within the wellbore, the fastener may fluidly isolate the internal chamber from wellbore fluid to maintain pressure within the internal chamber appreciably lower than wellbore fluid pressure thereby forming a pressure differential across the fastener. While the downhole tool is conveyed within the wellbore: the second fastener portion may block the wellbore fluid from entering the internal chamber; and after the first and second fastener portions are separated from each other, the pressure differential facilitates movement of the second fastener portion within the internal chamber to permit the wellbore fluid to flow into the internal chamber.

While the downhole tool is conveyed within the wellbore, pressure within the internal chamber may be maintained substantially constant.

While the downhole tool is conveyed within the wellbore, pressure within the internal chamber may be maintained substantially equal to atmospheric pressure at a wellsite surface from which the wellbore extends.

The fastener may divide the internal chamber into first and second chamber portions, the first chamber portion may be fluidly connected with the external space, and the fastener may fluidly isolate the first chamber portion from the second chamber portion.

The fastener may contain an explosive charge selectively operable to detonate to separate the fastener into the first and second fastener portions.

The first fastener portion may be connected with the first connector sub, and the second fastener portion may be connected with the second connector sub.

The fastener may be or comprise a bolt, the first fastener portion may be or comprise a shank of the bolt, and the second fastener portion may be or comprise a head of the bolt.

The first fastener portion may be threadedly connected with the first connector sub.

The second fastener portion may be latched against a shoulder of the second connector sub, and the second fastener portion may be movable within the internal chamber when the first and second fastener portions are separated from each other.

The downhole tool may be selectively operable to disconnect the first portion of the downhole tool string from the second portion of the downhole tool string when the first portion of the downhole tool string becomes stuck within the wellbore to permit the second portion of the downhole tool string to be retrieved to a wellsite surface from which the wellbore extends.

One of the first and second connector subs may be at least partially inserted into another of the first and second connector subs.

The first connector sub may comprise a fishing neck.

The downhole tool may further comprise an electrical conductor extending between opposing ends of the downhole tool through the first and second connector subs.

The first portion of the downhole tool string may comprise a perforating tool, and the second portion of the downhole tool string may comprise a depth correlation tool.

The second portion of the downhole tool string may comprise a jarring tool operable to impart an impact to the downhole tool string.

The present disclosure also introduces a method comprising: connecting a first connector sub of a downhole tool with a first portion of a downhole tool string and connecting a second connector sub of the downhole tool with a second portion of the downhole tool string to connect the first and second portions of the downhole tool string, wherein a fastener of the downhole tool connects the first and second connector subs; conveying the downhole tool string within a wellbore while the fastener blocks wellbore fluid from flowing into an internal chamber of the downhole tool; and operating the downhole tool to separate the fastener into first and second fastener portions thereby permitting the wellbore fluid to flow into the internal chamber to disconnect the first and second connector subs and thus disconnect the first and second portions of the downhole tool string from each other.

The method may further comprise assembling the downhole tool by: connecting the first fastener portion with the first connector sub; and connecting the second fastener portion with the second connector sub. Connecting the first fastener portion with the first connector sub may comprise threadedly engaging the first fastener portion with the first connector sub. Connecting the second fastener portion with the second connector sub may comprise slidably inserting at least a portion of the fastener into the internal chamber such that the second fastener portion: is disposed against a shoulder of the second connector sub; and fluidly seals the internal chamber.

The method may further comprise assembling the downhole tool by inserting a portion of one of the first and second connector subs into another of the first and second connector subs.

The method may further comprise, while conveying the downhole tool within the wellbore, maintaining the internal chamber at a pressure that is appreciably lower than hydrostatic wellbore pressure.

The method may further comprise, while conveying the downhole tool within the wellbore, maintaining the internal chamber at a pressure that is substantially equal to atmospheric pressure at wellsite surface from which the wellbore extends.

After the first and second fastener portions are separated from each other, wellbore fluid pressure may facilitate movement of the second fastener portion within the internal chamber to permit the wellbore fluid to flow into the internal chamber.

Operating the downhole tool may comprise detonating an explosive charge disposed in association with the fastener to separate the fastener into the first and second fastener portions.

Operating the downhole tool may be performed after the first portion of the downhole tool string becomes stuck within the wellbore to disconnect the first and second portions of the downhole tool string from each other to permit the second portion of the downhole tool string to be retrieved to wellsite surface from which the wellbore extends.

The method may further comprise transmitting a signal from a wellsite surface from which the wellbore extends to the downhole tool to operate the downhole tool.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to allow the reader to quickly ascertain the nature of the technical disclosure. It is submitted with the understanding that it will not be used to interpret or limit the scope or meaning of the claims.

What is claimed is:

1. An apparatus comprising:

an impact tool operable to be coupled between portions of a tool string conveyable within a wellbore extending into a subterranean formation, wherein the impact tool comprises:

a housing;

a chamber within the housing;

a piston slidably disposed within the chamber and dividing the chamber into a first chamber volume and a second chamber volume, wherein the first chamber volume is open to a space external to the housing, wherein the second chamber volume is fluidly isolated from the space external to the housing, and wherein the piston is operable to be maintained in a predetermined position within the chamber to maintain pressure within the second chamber volume appreciably lower than pressure within the first chamber volume while the impact tool is conveyed along the wellbore; and a shaft connected with the piston and axially movable with respect to the housing.

2. The apparatus of claim 1 wherein, while the impact tool is conveyed within the wellbore:

an opening in the housing permits the pressure within the first chamber volume to be maintained substantially equal to pressure within the space external to the housing thereby forming a pressure differential between the pressure within the first chamber volume and the pressure within the second chamber volume;

the pressure differential facilitates relative movement between the piston and housing; and the relative movement between the piston and housing ends with an impact between moving and stationary portions of the impact tool.

3. The apparatus of claim 1 wherein the pressure within the second chamber volume is maintained substantially equal to atmospheric pressure at a wellsite surface from which the wellbore extends.

4. The apparatus of claim 1 wherein the piston fluidly isolates the first chamber volume from the second chamber volume, and wherein, while the impact tool is conveyed within the wellbore:

the piston is releasable from the predetermined position to permit pressure differential between the pressure within the first chamber volume and the pressure within the second chamber volume facilitate relative movement between the piston and housing; and the relative movement ends with an impact between moving and stationary portions of the impact tool imparting an impact force to the downhole tool string.

5. The apparatus of claim 1 wherein the impact tool further comprises a mechanism operable to:

maintain the piston in the predetermined position within the chamber; and release the piston to permit pressure differential between the pressure within the first chamber volume and the pressure within the second chamber volume to move the piston and housing relative to each other thereby permitting a moving portion of the impact tool to impact a stationary portion of the impact tool.

6. The apparatus of claim 5 wherein the mechanism comprises a bolt coupling the piston with the housing, and wherein the bolt comprises an explosive charge operable to sever the bolt to release the piston from the housing.

7. The apparatus of claim 5 wherein the mechanism comprises a fluid valve.

8. The apparatus of claim 1 wherein the housing comprises one or more ports fluidly connecting the space external to the housing with the first chamber volume, and wherein the impact tool further comprises a flow restrictor for controlling rate of fluid flow from the space external to the housing into the first chamber volume through the port.

9. The apparatus of claim 1 wherein the piston further divides the chamber into a third chamber volume, wherein the third chamber volume is fluidly isolated from the second chamber volume and the space external to the housing, and wherein pressure within the third chamber volume is maintained appreciably lower than the pressure within the first chamber volume while the impact tool is conveyed along the wellbore.

10. The apparatus of claim 9 wherein the piston comprises a first piston portion having a first diameter and a second piston portion having a second diameter, wherein the first diameter is appreciably larger than the second diameter, wherein the first piston portion fluidly isolates the first chamber volume from the second chamber volume, and wherein the second piston portion fluidly isolates the first chamber volume from the third chamber volume.

11. An apparatus comprising:

an impact tool operable to be coupled between portions of a tool string conveyable within a wellbore extending into a subterranean formation, wherein the impact tool comprises:

a housing;

a chamber within the housing;

a piston slidably disposed within the chamber and dividing the chamber into a first chamber volume and a second chamber volume, wherein the first chamber volume is open to a space external to the housing, and wherein the second chamber volume is fluidly isolated from the space external to the housing;

a shaft connected with the piston and axially movable with respect to the housing; and a mechanism operable to:

maintain the piston in a predetermined position within the chamber; and release the piston to permit pressure differential between pressure within the first chamber volume and pressure within the second chamber volume to move the piston and housing relative to each other ending with an impact between moving and stationary portions of the impact tool.

12. The apparatus of claim 11 wherein, while the impact tool is conveyed within the wellbore:

an opening in the housing permits the pressure within the first chamber volume to be maintained substantially equal to pressure within the space external to the housing; and the mechanism is operable to maintain the piston in the predetermined position within the chamber to maintain pressure within the second chamber volume appreciably lower than the pressure within the first chamber volume thereby forming the pressure differential between the pressure within the first chamber volume and the pressure within the second chamber volume.

13. The apparatus of claim 12 wherein the pressure within the first chamber volume is maintained substantially equal to hydrostatic wellbore pressure within the space external to the housing, and the pressure within the second chamber volume is maintained substantially constant.

14. The apparatus of claim 11 wherein the mechanism comprises a bolt coupling the piston with the housing, and wherein the bolt comprises an explosive charge operable to sever the bolt to release the piston from the housing.

15. The apparatus of claim 11 wherein the mechanism comprises a fluid valve.

16. The apparatus of claim 11 wherein the piston further divides the chamber into a third chamber volume, wherein the third chamber volume is fluidly isolated from the second chamber volume and the space external to the housing, and wherein pressure within the third chamber volume is maintained appreciably lower than the pressure within the first chamber volume while the impact tool is conveyed along the wellbore.

17. A method comprising:

coupling an impact tool to a tool string, wherein the impact tool comprises:

a housing;

a chamber within the housing;

a piston slidably disposed within the chamber and dividing the chamber into a first chamber volume and a second chamber volume; and a shaft connected with the piston and axially movable with respect to the housing; and conveying the tool string within a wellbore while:

maintaining pressure within the first chamber volume substantially equal to pressure within space external to the housing; and maintaining the piston in a predetermined position within the chamber to maintain pressure within the second chamber volume appreciably lower than the pressure within the first chamber volume thereby forming a pressure differential between the pressure within the first chamber volume and the pressure within the second chamber volume.

18. The method of claim 17 further comprising operating the impact tool to permit the pressure differential to facilitate relative movement between the piston and housing resulting in an impact between a moving portion of the impact tool and a stationary portion of the impact tool.

19. The method of claim 18 wherein operating the impact tool comprises uncoupling the piston from the housing to permit the pressure differential to facilitate the relative movement between the piston and housing.

20. The method of claim 19 wherein uncoupling the piston from the housing comprises detonating an explosive charge to sever a latching member coupling the piston and the housing.

* * * * *